US006837569B2

(12) United States Patent
Kim

(10) Patent No.: US 6,837,569 B2
(45) Date of Patent: Jan. 4, 2005

(54) SHINGLING ALGORITHMS FOR EDGE PRINTING AND PRINTER USING THE SAME

(75) Inventor: Hyun Kim, Gyeonggi-do (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/419,867

(22) Filed: Apr. 22, 2003

(65) Prior Publication Data

US 2003/0231224 A1 Dec. 18, 2003

Related U.S. Application Data

(60) Provisional application No. 60/387,594, filed on Jun. 12, 2002.

(51) Int. Cl.[7] ..... B41J 2/145; B41J 2/15; B41J 29/38

(52) U.S. Cl. ..... 347/41; 347/16

(58) Field of Search ..... 347/41, 40, 16, 347/37, 15

(56) References Cited

U.S. PATENT DOCUMENTS

| | | | | | |
|---|---|---|---|---|---|
| 5,600,353 | A | * | 2/1997 | Hickman et al. | 347/43 |
| 5,640,183 | A | * | 6/1997 | Hackleman | 347/40 |
| 6,336,703 | B1 | * | 1/2002 | Otsuki | 347/41 |
| 2002/0070991 | A1 | | 6/2002 | Otsuki | |

FOREIGN PATENT DOCUMENTS

| | | |
|---|---|---|
| EP | 925 920 | 6/1999 |
| EP | 043 166 | 10/2000 |
| EP | 1 197 343 | 4/2002 |

* cited by examiner

*Primary Examiner*—Thinh Nguyen
(74) *Attorney, Agent, or Firm*—Staas & Halsey LLP

(57) ABSTRACT

Shingling method and apparatus for front and back edge printing in a printing apparatus include a line feeding motor rotating step by step according to a shingling mode that appropriately varies during a shingling operation, so that high quality edge printing can be achieved.

56 Claims, 29 Drawing Sheets

FIG. 8A

| | 1 | 2 | 3 | 4 | 5 | 6 | 7 | 8 | 9 |
|---|---|---|---|---|---|---|---|---|---|
| 35-1 | 1/8(1/8) 1 | 1/8(1/8) 2 | 5/8(5/8) 7 | 1/8(1/8) 8 | 1/8(1/8) 9 | 1/8(1/8) 10 | 1/8(1/8) 11 | 1/8(1/8) 12 | 1/8(1/8) 13 |
| 35-2 | | 1/8(2/8) 1 | 5/8(5/8) 6 | (5/8) 7 | 1/8(2/8) 8 | 1/8(2/8) 9 | 1/8(2/8) 10 | 1/8(2/8) 11 | 1/8(2/8) 12 |
| 35-3 | | | 5/8(5/8) 5 | (5/8) 6 | (5/8) 7 | 1/8(3/8) 8 | 1/8(3/8) 9 | 1/8(3/8) 10 | 1/8(3/8) 11 |
| 35-4 | | | 5/8(5/8) 4 | (5/8) 5 | (5/8) 6 | (5/8) 7 | 1/8(4/8) 8 | 1/8(4/8) 9 | 1/8(4/8) 10 |
| 35-5 | | | 5/8(5/8) 3 | (5/8) 4 | (5/8) 5 | (5/8) 6 | (5/8) 7 | 1/8(5/8) 8 | 1/8(5/8) 9 |
| 35-6 | | | 5/8(6/8) 2 | 1/8(6/8) 3 | 1/8(6/8) 4 | 1/8(6/8) 5 | 1/8(6/8) 6 | 1/8(6/8) 7 | 1/8(6/8) 8 |
| 35-7 | | | 5/8(7/8) 1 | 1/8(7/8) 2 | 1/8(7/8) 3 | 1/8(7/8) 4 | 1/8(7/8) 5 | 1/8(7/8) 6 | 1/8(7/8) 7 |
| 35-8 | | | | 1/8(8/8) 1 | 1/8(8/8) 2 | 1/8(8/8) 3 | 1/8(8/8) 4 | 1/8(8/8) 5 | 1/8(8/8) 6 |

FIG. 8B

| | 1 | 2 | 3 | 4 | 5 | 6 | 7 | 8 | 9 |
|---|---|---|---|---|---|---|---|---|---|
| 35-1 | 1/8(1/8)① | 1/8(1/8)② | 4/8(4/8)⑥ | 1/8(1/8)⑦ | 1/8(1/8)⑧ | 1/8(1/8)⑨ | 1/8(1/8)⑩ | 1/8(1/8)⑪ | 1/8(1/8)⑫ |
| 35-2 | | 1/8(2/8)① | 4/8(4/8)⑤ | (4/8)⑥ | 1/8(2/8)⑦ | 1/8(2/8)⑧ | 1/8(2/8)⑨ | 1/8(2/8)⑩ | 1/8(2/8)⑪ |
| 35-3 | | | 4/8(4/8)④ | (4/8)⑤ | (4/8)⑥ | 1/8(3/8)⑦ | 1/8(3/8)⑧ | 1/8(3/8)⑨ | 1/8(3/8)⑩ |
| 35-4 | | | 4/8(4/8)③ | (4/8)④ | (4/8)⑤ | (4/8)⑥ | 1/8(4/8)⑦ | 1/8(4/8)⑧ | 1/8(4/8)⑨ |
| 35-5 | | | 4/8(5/8)② | 1/8(5/8)③ | 1/8(5/8)④ | 1/8(5/8)⑤ | 1/8(5/8)⑥ | 1/8(5/8)⑦ | 1/8(5/8)⑧ |
| 35-6 | | | 4/8(6/8)① | 1/8(6/8)② | 1/8(6/8)③ | 1/8(6/8)④ | 1/8(6/8)⑤ | 1/8(6/8)⑥ | 1/8(6/8)⑦ |
| 35-7 | | | | 1/8(7/8)① | 1/8(7/8)② | 1/8(7/8)③ | 1/8(7/8)④ | 1/8(7/8)⑤ | 1/8(7/8)⑥ |
| 35-8 | | | | | 1/8(8/8)① | 1/8(8/8)② | 1/8(8/8)③ | 1/8(8/8)④ | 1/8(8/8)⑤ |

FIG. 8C

| | 1 | 2 | 3 | 4 | 5 | 6 | 7 | 8 | 9 |
|---|---|---|---|---|---|---|---|---|---|
| 35-1 | 1/8(1/8)1 | 7/8(7/8)8 | 1/8(1/8)9 | 1/8(1/8)10 | 1/8(1/8)11 | 1/8(1/8)12 | 1/8(1/8)13 | 1/8(1/8)14 | 1/8(1/8)15 |
| 35-2 | | 7/8(7/8)7 | (7/8)8 | 1/8(2/8)9 | 1/8(2/8)10 | 1/8(2/8)11 | 1/8(2/8)12 | 1/8(2/8)13 | 1/8(2/8)14 |
| 35-3 | | 7/8(7/8)6 | (7/8)7 | (7/8)8 | 1/8(3/8)9 | 1/8(3/8)10 | 1/8(3/8)11 | 1/8(3/8)12 | 1/8(3/8)13 |
| 35-4 | | 7/8(7/8)5 | (7/8)6 | (7/8)7 | (7/8)8 | 1/8(4/8)9 | 1/8(4/8)10 | 1/8(4/8)11 | 1/8(4/8)12 |
| 35-5 | | 7/8(7/8)4 | (7/8)5 | (7/8)6 | (7/8)7 | (7/8)8 | 1/8(5/8)9 | 1/8(5/8)10 | 1/8(5/8)11 |
| 35-6 | | 7/8(7/8)3 | (7/8)4 | (7/8)5 | (7/8)6 | (7/8)7 | (7/8)8 | 1/8(6/8)9 | 1/8(6/8)10 |
| 35-7 | | 7/8(7/8)2 | (7/8)3 | (7/8)4 | (7/8)5 | (7/8)6 | (7/8)7 | (7/8)8 | 1/8(7/8)9 |
| 35-8 | | 7/8(8/8)1 | 1/8(8/8)2 | 1/8(8/8)3 | 1/8(8/8)4 | 1/8(8/8)5 | 1/8(8/8)6 | 1/8(8/8)7 | 1/8(8/8)8 |

FIG. 8D

| | 1 | 2 | 3 | 4 | 5 | 6 | 7 | 8 | 9 |
|---|---|---|---|---|---|---|---|---|---|
| 35-1 | 1/8(1/8)1 | 6/8(6/8)7 | 1/8(1/8)8 | 1/8(1/8)9 | 1/8(1/8)10 | 1/8(1/8)11 | 1/8(1/8)12 | 1/8(1/8)13 | 1/8(1/8)14 |
| 35-2 | | 6/8(6/8)6 | (6/8)7 | 1/8(2/8)8 | 1/8(2/8)9 | 1/8(2/8)10 | 1/8(2/8)11 | 1/8(2/8)12 | 1/8(2/8)13 |
| 35-3 | | 6/8(6/8)5 | (6/8)6 | (6/8)7 | 1/8(3/8)8 | 1/8(3/8)9 | 1/8(3/8)10 | 1/8(3/8)11 | 1/8(3/8)12 |
| 35-4 | | 6/8(6/8)4 | (6/8)5 | (6/8)6 | (6/8)7 | 1/8(4/8)8 | 1/8(4/8)9 | 1/8(4/8)10 | 1/8(4/8)11 |
| 35-5 | | 6/8(6/8)3 | (6/8)4 | (6/8)5 | (6/8)6 | (6/8)7 | 1/8(5/8)8 | 1/8(5/8)9 | 1/8(5/8)10 |
| 35-6 | | 6/8(6/8)2 | (6/8)3 | (6/8)4 | (6/8)5 | (6/8)6 | (6/8)7 | 1/8(6/8)8 | 1/8(6/8)9 |
| 35-7 | | 6/8(7/8)1 | 1/8(7/8)2 | 1/8(7/8)3 | 1/8(7/8)4 | 1/8(7/8)5 | 1/8(7/8)6 | 1/8(7/8)7 | 1/8(7/8)8 |
| 35-8 | | | 1/8(8/8)1 | 1/8(8/8)2 | 1/8(8/8)3 | 1/8(8/8)4 | 1/8(8/8)5 | 1/8(8/8)6 | 1/8(8/8)7 |

FIG. 9A

| | 1 | 2 | 3 | 4 | 5 | 6 |
|---|---|---|---|---|---|---|
| 45-1 | 1/5(1/5)① | 3/5(3/5)④ | 1/5(1/5)⑤ | 1/5(1/5)⑥ | 1/5(1/5)⑦ | 1/5(1/5)⑧ |
| 45-2 | | 3/5(3/5)③ | (3/5)④ | 1/5(2/5)⑤ | 1/5(2/5)⑥ | 1/5(2/5)⑦ |
| 45-3 | | 3/5(3/5)② | (3/5)③ | (3/5)④ | 1/5(3/5)⑤ | 1/5(3/5)⑥ |
| 45-4 | | 3/5(4/5)① | 1/5(4/5)② | 1/5(4/5)③ | 1/5(4/5)④ | 1/5(4/5)⑤ |
| 45-5 | | | 1/5(5/5)① | 1/5(5/5)② | 1/5(5/5)③ | 1/5(5/5)④ |

FIG. 9B

| | 1 | 2 | 3 | 4 | 5 | 6 |
|---|---|---|---|---|---|---|
| 45-1 | 1/5(1/5)① | 4/5(4/5)⑤ | 1/5(1/5)⑥ | 1/5(1/5)⑦ | 1/5(1/5)⑧ | 1/5(1/5)⑨ |
| 45-2 | | 4/5(4/5)④ | (4/5)⑤ | 1/5(2/5)⑥ | 1/5(2/5)⑦ | 1/5(2/5)⑧ |
| 45-3 | | 4/5(4/5)③ | (4/5)④ | (4/5)⑤ | 1/5(3/5)⑥ | 1/5(3/5)⑦ |
| 45-4 | | 4/5(4/5)② | (4/5)③ | (4/5)④ | (4/5)⑤ | 1/5(4/5)⑥ |
| 45-5 | | 4/5(5/5)① | 1/5(5/5)② | 1/5(5/5)③ | 1/5(5/5)④ | 1/5(5/5)⑤ |

FIG. 10

| | 1 | 2 | 3 | 4 | 5 |
|---|---|---|---|---|---|
| 55-1 | 1/4(1/4)① | 3/4(3/4)④ | 1/4(1/4)⑤ | 1/4(1/4)⑥ | 1/4(1/4)⑦ |
| 55-2 | | 3/4(3/4)③ | (3/4)④ | 1/4(2/4)⑤ | 1/4(2/4)⑥ |
| 55-3 | | 3/4(3/4)② | (3/4)③ | (3/4)④ | 1/4(3/4)⑤ |
| 55-4 | | 3/4(4/4)① | 1/4(4/4)② | 1/4(4/4)③ | 1/4(4/4)④ |

FIG. 13A

| | 1 | 2 | 3 | 4 | 5 | 6 | 7 | 8 |
|---|---|---|---|---|---|---|---|---|
| 35-1 | 1/8(1/8)④ | 1/8(1/8)⑤ | 1/8(1/8)⑥ | 1/8(1/8)⑦ | 5/8(5/8)⑧ | | | |
| 35-2 | 1/8(2/8)③ | 1/8(2/8)④ | 1/8(2/8)⑤ | 1/8(2/8)⑥ | 5/8(6/8)⑦ | | | |
| 35-3 | 1/8(3/8)② | 1/8(3/8)③ | 1/8(3/8)④ | 1/8(3/8)⑤ | 5/8(7/8)⑥ | | | |
| 35-4 | (3/8)① | (3/8)② | (3/8)③ | (3/8)④ | 5/8(8/8)⑤ | | | |
| 35-5 | 1/8(5/8) | (3/8)① | (3/8)② | (3/8)③ | 5/8(8/8)④ | | | |
| 35-6 | 1/8(6/8) | 1/8(6/8) | (3/8)① | (3/8)② | 5/8(8/8)③ | 1/8(6/8)⑧ | | |
| 35-7 | 1/8(7/8) | 1/8(7/8) | 1/8(7/8) | (3/8)① | 5/8(8/8)② | 1/8(7/8)⑦ | 1/8(7/8)⑧ | |
| 35-8 | 1/8(8/8) | 1/8(8/8) | 1/8(8/8) | 1/8(8/8) | 5/8(8/8)① | 1/8(8/8)⑥ | 1/8(8/8)⑦ | 1/8(8/8)⑧ |

FIG. 13B

| | 1 | 2 | 3 | 4 | 5 | 6 | 7 | 8 |
|---|---|---|---|---|---|---|---|---|
| 35-1 | 1/8(1/8) 4 | 1/8(1/8) 5 | 1/8(1/8) 6 | 1/8(1/8) 7 | 5/8(5/8) 8 | | | |
| 35-2 | 1/8(2/8) 3 | 1/8(2/8) 4 | 1/8(2/8) 5 | 1/8(2/8) 6 | 5/8(6/8) 7 | 1/8(7/8) 8 | | |
| 35-3 | 1/8(3/8) 2 | 1/8(3/8) 3 | 1/8(3/8) 4 | 1/8(3/8) 5 | 5/8(7/8) 6 | 1/8(6/8) 7 | | |
| 35-4 | (3/8) 1 | (3/8) 2 | (3/8) 3 | (3/8) 4 | 5/8(8/8) 5 | 1/8(8/8) 6 | | |
| 35-5 | 1/8(5/8) | (3/8) 1 | (3/8) 2 | (3/8) 3 | 5/8(8/8) 4 | (8/8) 5 | | |
| 35-6 | 1/8(6/8) | 1/8(6/8) | (3/8) 1 | (3/8) 2 | 5/8(8/8) 3 | (8/8) 4 | | |
| 35-7 | 1/8(7/8) | 1/8(7/8) | 1/8(7/8) | (3/8) 1 | 5/8(8/8) 2 | 8/8) 3 | 1/8(7/8) 8 | |
| 35-8 | 1/8(8/8) | 1/8(8/8) | 1/8(8/8) | 1/8(8/8) | 5/8(8/8) 1 | (8/8) 2 | 1/8(8/8) 7 | 1/8(8/8) 8 |

FIG. 13C

| | 1 | 2 | 3 | 4 | 5 | 6 | 7 | 8 |
|---|---|---|---|---|---|---|---|---|
| 35-1 | 1/8(1/8)③ | 1/8(1/8)④ | 1/8(1/8)⑤ | 1/8(1/8)⑥ | 1/8(1/8)⑦ | 6/8(6/8)⑧ | | |
| 35-2 | 1/8(2/8)② | 1/8(2/8)③ | 1/8(2/8)④ | 1/8(2/8)⑤ | 1/8(2/8)⑥ | 6/8(7/8)⑦ | | |
| 35-3 | (2/8)① | (2/8)② | (2/8)③ | (2/8)④ | (2/8)⑤ | 6/8(8/8)⑥ | | |
| 35-4 | 1/8(4/8) | (2/8)① | (2/8)② | (2/8)③ | (2/8)④ | 6/8(8/8)⑤ | | |
| 35-5 | 1/8(5/8) | 1/8(5/8) | (2/8)① | (2/8)② | (2/8)③ | 6/8(8/8)④ | | |
| 35-6 | 1/8(6/8) | 1/8(6/8) | 1/8(6/8) | (2/8)① | (2/8)② | 6/8(8/8)③ | | |
| 35-7 | 1/8(7/8) | 1/8(7/8) | 1/8(7/8) | 1/8(7/8) | (2/8)① | 6/8(8/8)② | 1/8(7/8)⑧ | |
| 35-8 | 1/8(8/8) | 1/8(8/8) | 1/8(8/8) | 1/8(8/8) | 1/8(8/8) | 6/8(8/8)① | 1/8(8/8)⑦ | 1/8(8/8)⑧ |

FIG. 13D

| | 1 | 2 | 3 | 4 | 5 | 6 | 7 | 8 |
|---|---|---|---|---|---|---|---|---|
| 35-1 | 1/8(1/8) ② | 1/8(1/8) ③ | 1/8(1/8) ④ | 1/8(1/8) ⑤ | 1/8(1/8) ⑥ | 1/8(1/8) ⑦ | 7/8(7/8) ⑧ | |
| 35-2 | (1/8) ① | (1/8) ② | (1/8) ③ | (1/8) ④ | (1/8) ⑤ | (1/8) ⑥ | 7/8(8/8) ⑦ | |
| 35-3 | 1/8(3/8) | (1/8) ① | (1/8) ② | (1/8) ③ | (1/8) ④ | (1/8) ⑤ | 7/8(8/8) ⑥ | |
| 35-4 | 1/8(4/8) | 1/8(4/8) | (1/8) ① | (1/8) ② | (1/8) ③ | (1/8) ④ | 7/8(8/8) ⑤ | |
| 35-5 | 1/8(5/8) | 1/8(5/8) | 1/8(5/8) | (1/8) ① | (1/8) ② | (1/8) ③ | 7/8(8/8) ④ | |
| 35-6 | 1/8(6/8) | 1/8(6/8) | 1/8(6/8) | 1/8(6/8) | (1/8) ① | (1/8) ② | 7/8(8/8) ③ | |
| 35-7 | 1/8(7/8) | 1/8(7/8) | 1/8(7/8) | 1/8(7/8) | 1/8(7/8) | (1/8) ① | 7/8(8/8) ② | |
| 35-8 | 1/8(8/8) | 1/8(8/8) | 1/8(8/8) | 1/8(8/8) | 1/8(8/8) | 1/8(8/8) | 7/8(8/8) ① | 1/8(8/8) ⑧ |

FIG. 14A

| | 1 | 2 | 3 | 4 | 5 |
|---|---|---|---|---|---|
| 45-1 | 1/5(1/5) ③ | 1/5(1/5) ④ | 3/5(3/5) ⑤ | | |
| 45-2 | 1/5(2/5) ② | 1/5(2/5) ③ | 3/5(4/5) ④ | | |
| 45-3 | (2/5) ① | (2/5) ② | 3/5(5/5) ③ | | |
| 45-4 | 1/5(4/5) | (2/5) ① | 3/5(5/5) ② | 1/5(4/5) ⑤ | |
| 45-5 | 1/5(5/5) | 1/5(5/5) | 3/5(5/5) ① | 1/5(5/5) ④ | 1/5(5/5) ⑤ |

FIG. 14B

| | 1 | 2 | 3 | 4 | 5 |
|---|---|---|---|---|---|
| 45-1 | 1/5(1/5) ② | 1/5(1/5) ③ | 1/5(1/5) ④ | 4/5(4/5) ⑤ | |
| 45-2 | (1/5) ① | (1/5) ② | (1/5) ③ | 4/5(5/5) ④ | |
| 45-3 | 1/5(3/5) | (1/5) ① | (1/5) ② | 4/5(5/5) ③ | |
| 45-4 | 1/5(4/5) | 1/5(4/5) | (1/5) ① | 4/5(5/5) ② | |
| 45-5 | 1/5(5/5) | 1/5(5/5) | 1/5(5/5) | 4/5(5/5) ① | 1/5(5/5) ⑤ |

FIG. 15

| | 1 | 2 | 3 | 4 |
|---|---|---|---|---|
| 55-1 | 1/4(1/4) ② | 1/4(1/4) ③ | 3/4(3/4) ④ | |
| 55-2 | (1/4) ① | (1/4) ② | 3/4(4/4) ③ | |
| 55-3 | 1/4(3/4) | (1/4) ① | 3/4(4/4) ② | |
| 55-4 | 1/4(4/4) | 1/4(4/4) | 3/4(4/4) ① | 1/4(4/4) ④ |

SHINGLING ALGORITHMS FOR EDGE PRINTING AND PRINTER USING THE SAME

CROSS-REFERENCE TO RELATED APPLICATIONS

This application claims priority from U.S. Provisional Patent Application No. 60/387,594, filed on Jun. 12, 2002, in the U.S. Patent and Trademark Office, the disclosure of which is incorporated herein in its entirety by reference.

BACKGROUND OF THE INVENTION

1. Field of the Invention

The present invention relates to a shingling algorithm, and more particularly, to a shingling algorithm for edge printing.

2. Description of the Related Art

In a conventional printing apparatus as shown in FIG. 1, a sheet of printing paper 11 is fed between a paper feed roller 12 and a pressure roller 14 in a paper feed direction perpendicular to a scanning direction in which the printing paper 11 is scanned as indicated by an arrow of the scanning direction. While the printing paper 11 is moved beneath a head 15, ink is discharged through a nozzle (not shown) of an ink cartridge (not shown) mounted on the head 15 for printing. The head 15 reciprocates in the scanning direction perpendicular to the paper feed direction in which the printing paper 11 is supplied, while the ink is discharged. The printing paper 11 after printing is output from the printing apparatus by a paper exit roller 16 and a star wheel 18.

FIG. 2 shows the printing paper 11 after printing using a conventional method performed in the conventional printing apparatus as described with reference to FIG. 1. As shown in FIG. 2, when a printing command is input to the conventional printing apparatus, data are printed only in a region E of the printing paper 11, not in edge regions A, B, C, and D. In other words, the data cannot be printed in the edge regions A, B, C, and D with the conventional printing apparatus even when a user designates all edge margins to zero.

To improve this problem, an apparatus for and method of edge printing without roller contamination are disclosed in U.S. Patent No. 2002/0070991 A1.

FIG. 3 is a sectional view of a conventional printing apparatus disclosed in U.S. Patent No. 2002/0070991 A1. Referring to FIG. 3, a sheet of printing paper P is transferred in a sub-scanning direction (paper feed direction) while supported by paper feed rollers 25*a* and 25*b*. When a front edge of the printing paper P passes between paper exit rollers 25*c* and 25*d*, a back (bottom or rear) edge Pr of the printing paper P reaches a front rib 26*f* and a flatten 26. At this time, ink Ip is discharged from a head 28 for back edge printing. The head 28 includes a plurality of nozzles (#1–#8). Since the back edge printing is initiated before the back edge Pr of the printing paper P reaches the last nozzle #8, the back edge printing can be achieved without leaving a margin at the back edge Pr of the printing paper P even when the printing paper P is improperly fed. Ink droplets discharged out toward the printing paper P are absorbed by an absorption member 27*f*. The conventional printing apparatus further includes another rib 26*r* and another absorption member 27*r*. Although this method enables printing in upper, lower, left, and right margins of the printing paper P, there is a need for high quality edge printing using software, such as a shingling algorithm.

SUMMARY OF THE INVENTION

The present invention provides shingling algorithms for high quality edge printing in a printing apparatus.

Additional aspects and advantages of the invention will be set forth in part in the description which follows and, in part, will be obvious from the description, or may be learned by practice of the invention.

In accordance with one aspect of the present invention, a shingling method for front edge printing includes (a) setting a 1/n×100% shingling mode as a default of a printing apparatus to divide a nozzle portion of an ink head into nozzle sections 1 through n in a paper advance (feed) direction and a front edge region of a sheet of printing paper into first through $n^{th}$ front edge regions having the same width as each nozzle section of the ink head in the paper advance direction, (b) rotating a line feeding motor so that the first front edge region of the printing paper lines up beneath the nozzle section 1 of the ink head, to set a parameter m, which is an integer indicating the number of printing operations, to 1, and to perform printing on the first front edge region of the printing paper in the 1/n×100% shingling mode, (c) when the first front edge region of the printing paper lines up beneath the nozzle section 2 of the ink head, increasing the parameter m to 2 to perform printing on the first and second front edge regions of the printing paper in the 1/n×100% shingling mode, (d) when the first front edge region of the printing paper lines up beneath the nozzle section (s+2), where 1<s<n, increasing the parameter m to (s+2) to perform printing on the first through $(s+2)^{th}$ front edge regions of the printing paper in a s/n×100% shingling mode, (e) increasing the parameter m by 1 to perform printing on regions of the printing paper excluding $m^{th}$ trough $(s+2)^{th}$ front edge regions in the 1/n×100% shingling mode, and (f) repeating the operation (e) until m=s+2, to rotate the line feeding motor in a single step if m=s+2, and to perform printing on the regions of the printing paper beneath the nozzle sections n through 1 of the ink head in the 1/n×100% shingling mode.

According to another aspect of the above shingling method for front edge printing on the printing paper having different sizes, the printing apparatus includes a plurality of ribs disposed at intervals between a paper feed roller and a paper exit roller in a scanning direction perpendicular to the paper advance direction. In operation (b), ink is discharged from the nozzle section 1 of the ink head. In operation (c), the line feeding motor is rotated by a single step, and the ink is discharged from the nozzle sections 2 and 1 of the ink head positioned above the first and second front edge regions of the printing paper. In operation (d), the line feeding motor is rotated in s steps, and the ink is discharged from the nozzle sections (s+2) through 1 of the ink head positioned above the first through $(s+2)^{th}$ front edge regions of the printing paper. In operation (e), the line feeding motor is rotated by a single step, and the ink is discharged from the nozzle sections excluding the nozzle sections s through $(m-2)^{th}$ of the ink head positioned above $m^{th}$ through $(s+2)^{th}$ front edge regions of the printing paper. The shingling method further includes, after step (f), rotating the line feeding motor by a single step, increasing the parameter m by 1, and performing printing on the regions of the printing paper beneath the nozzle sections 1 through n of the ink head in the 1/n×100% shingling mode. In the above shingling method, n is an integer greater than 4.

The present invention also provides a shingling method for front edge printing, and the method includes (a) setting a 1/n×100% shingling mode as a default in a printing apparatus to divide a nozzle portion of an ink head into nozzle sections 1 through n in a paper advance (feed) direction and a front edge region of a sheet of printing paper into first through $n^{th}$ front edge regions having the same width as each nozzle section of the ink head in the paper advance direction, (b) rotating a line feeding motor so that the first front edge region of the printing paper lines up beneath the nozzle section 1 of the ink head, to set a parameter m, which is an integer indicating the number of printing operations, to 1, and to perform printing on the first front edge region of the printing paper in the 1/n×100% shingling mode, (c) when the first front edge region of the printing paper lines up beneath the nozzle section (s+1), where 1<s<2, of the ink head, increasing the parameter m to 2 to perform printing on the first through $(s+1)^{th}$ front edge regions of the printing paper in a s/n×100% shingling mode, (d) increasing the parameter m by 1 to perform printing on the regions of the printing paper excluding $m^{th}$ trough $(s+1)^{th}$ front edge regions in the 1/n×100% shingling mode, and (e) repeating operation (d) until m=s+1, rotating the line feeding motor by a single step if m=s+1, increasing the parameter m by 1, and performing printing on the regions of the printing paper beneath the nozzle sections n through 1 of the ink head in the 1/n×100% shingling mode.

According to another aspect of the above shingling method for front edge printing on the printing paper having different sizes, the printing apparatus includes a plurality of ribs disposed at intervals between a paper feed roller and a paper exit roller in a scanning direction perpendicular to the paper advance direction. In operation (b), ink is discharged from the nozzle section 1 of the ink head. In operation (c), the line feeding motor is rotated by s steps, and the ink is discharged from the nozzle sections (s+1) through 1 of the ink head positioned above the first through $(s+2)^{th}$ front edge regions of the printing paper. In operation (d), the line feeding motor is rotated in a single step, and the ink is discharged from the nozzle sections excluding the nozzle sections s through 2 of the ink head positioned above the $m^{th}$ through $(s+1)^{th}$ front edge regions of the printing paper. The shingling method further includes, after operation (e), rotating the line feeding motor by a single step to perform printing on the regions of the printing paper positioned beneath the nozzle sections n through 1 of the ink head in the 1/n×100% shingling mode. In the above shingling method, n is an integer greater than 3.

In accordance with another aspect of the present invention, a shingling method for back edge printing includes (a) setting a 1/n×100% shingling mode as a default in a printing apparatus to divide a nozzle portion of an ink head into nozzle sections 1 through n in a paper advance (feed) direction and to divide a back edge region of a sheet of printing paper into first through $n^{th}$ back edge regions having the same width as each nozzle section of the ink head in the paper advance direction, (b) rotating a line feeding motor so that the first back edge region of the printing paper lines up beneath the nozzle section r, where 2<r<n−1, of the ink head, to set a parameter m, which is an integer indicating the number of printing operations, to 1, and to perform printing on regions of the printing paper excluding the first back edge region in the 1/n×100% shingling mode, (c) rotating the line feeding motor by a single step to increase the parameter m by 1, and to perform printing on the regions of the printing paper excluding the first through $m^{th}$ back edge regions in the 1/n×100% shingling mode, (d) repeating operation (c) until m=n−r to perform printing on the first through $n^{th}$ back edge regions of the printing paper in a m/n×100% shingling mode if m=n−r+1, (e) rotating the line feeding motor in a single step to increase the parameter m by 1, and to perform printing on the $m^{th}$ through $n^{th}$ back edge regions of the printing paper in the 1/n×100% shingling mode, (f) rotating the line feeding motor such that the second through $m^{th}$ back edge regions of the printing paper is drawn out from the ink head, to perform printing on the $m^{th}$ through $n^{th}$ back edge regions in the 1/n×100% shingling mode, and (g) rotating the line feeding motor by a single step to increase the parameter m by 1, and to perform printing on the $m^{th}$ through $n^{th}$ back edge regions in the 1/n×100% shingling mode until m=n.

According to another aspect of the above shingling method for back edge printing on the printing paper having different sizes, the printing apparatus includes a plurality of ribs disposed at intervals between a paper feed roller and a paper exit roller in a scanning direction perpendicular to the paper advance direction. In operation (b), ink is discharged from the nozzle sections of the ink head excluding the nozzle section r. In operation (c), the ink is discharged from the nozzle sections (r+m−1) through r positioned above the first through $m^{th}$ back edge regions of the printing paper. In operation (e), the ink is discharged from the nozzle sections r through 2 of the ink head positioned above the $m^{th}$ and $n^{th}$ back edge regions of the printing paper. In operation (f), the line feeding motor is rotated in n−r+1 steps, and the ink is discharged from the nozzle sections n through m of the ink head positioned above the $m^{th}$ through $n^{th}$ back edge regions of the printing paper. In the above shingling method, n is an integer greater than 3.

The present invention also provides a shingling method for back edge printing, and the method includes (a) setting a 1/n×100% shingling mode as a default in a printing apparatus to divide a nozzle portion of an ink head into nozzle sections 1 through n in a paper advance (feed) direction and a back edge region of a sheet of printing paper into first through $n^{th}$ back edge regions having the same width as each nozzle section of the ink head in the paper advance direction, (b) rotating a line feeding motor so that the first back edge region of the printing paper lines up beneath nozzle section r, where 1<r<n, of the ink head, to set a parameter m, which is an integer indicating the number of printing operations, to 1, and to perform printing on regions of the printing paper excluding the first back edge region in the 1/n×100% shingling mode, (c) rotating the line feeding motor by a single step to increase the parameter m by 1 and to perform printing on the regions of the printing paper excluding the first through $m^{th}$ back edge regions in the 1/n×100% shingling mode, (d) repeating operation (c) until m=n−r, to perform printing on the first through nth back edge regions in a m/n×100% shingling mode if m=n−r+1, (e) rotating the line feeding motor by (n−r+1) steps to increase the parameter m by 1 and to perform printing on the $m^{th}$ through $n^{th}$ back edge regions of the printing paper in the 1/n×100% shingling mode, and (f) rotating the line feeding motor in a single step to increase the parameter m by 1, and to perform printing on the $m^{th}$ through $n^{th}$ back edge regions of the printing paper in the 1/n×100% shingling mode until m=n.

According to another aspect of the above shingling method for back edge printing, the printing paper has one of different sizes. The printing apparatus includes a plurality of ribs disposed at intervals between a paper feed roller and a paper exit roller in a scanning direction perpendicular to the paper advance direction. In operation (b), ink is discharged from the nozzle sections of the ink head excluding nozzle section r. In operation (c), the ink is discharged from the nozzle sections of the ink head excluding the nozzle sections (r+m−1) through r positioned above the first through $m^{th}$ back edge regions of the printing paper. In operation (d), the ink is discharged from the nozzle sections n through 1 of the ink head positioned above the first through $n^{th}$ back edge regions of the printing paper. In operation (e), the ink is discharged from the nozzle sections n through m of the ink head positioned above the $m^{th}$ through $n^{th}$ back edge regions of the printing paper. In operation (f), the ink is discharged from the nozzle sections n through m of the ink head positioned above the $m^{th}$ through $n^{th}$ back edge regions of the printing paper. In the above shingling method, n is an integer greater than 3.

The present invention provides a shingling method for back edge printing. The method includes (a) setting a 1/n×100% shingling mode as a default in a printing apparatus to divide a nozzle portion of an ink head into nozzle sections 1 through n in a paper advance (feed) direction and to divide a back edge region of a sheet of printing paper into first through $n^{th}$ back edge regions having the same width as each nozzle section of the ink head in the paper advance direction, (b) rotating a line feeding motor so that the first back edge region of the printing paper lines up beneath the nozzle section 2 of the ink head, to set a parameter m, which is an integer indicating the number of printing operations, to 1, and to perform printing on regions of the printing paper excluding the first back edge region in a 1/n×100% shingling mode, (c) rotating the line feeding motor by a single step to increase the parameter m by 1 and to perform printing on regions of the printing paper excluding the first through $m^{th}$ back edge regions in a 1/n×100% shingling mode, (d) repeating operation (c) until m=n−2, to perform printing on the first through $n^{th}$ back edge regions of the printing paper in a m/n×100% shingling mode if m=n−1, and (e) rotating the line feeding motor by (n−1) steps to increase the parameter m to n, and to perform printing on the $n^{th}$ back edge region of the printing paper in the 1/n×100% shingling mode.

According to another aspect of the above shingling method for back edge printing, the printing paper has one of different sizes. The printing apparatus includes a plurality of ribs disposed at intervals between a paper feed roller and a paper exit roller in a scanning direction perpendicular to the paper advance direction. In operation (b), ink is discharged from the nozzle sections of the ink head excluding nozzle section 2. In operation (c), the ink is discharged from the nozzle sections of the ink head excluding the nozzle sections nozzle sections (m+1) through 2 positioned above the first through $m^{th}$ back edge regions of the printing paper. In operation (d), the ink is discharged from the nozzle sections n through 1 positioned above the first through $n^{th}$ back edge regions of the printing paper. In the above shingling method, n is an integer greater than 3.

As described above, high quality edgeless printing can be achieved using the shingling algorithms according to the present invention.

According to another aspect of the present invention, a shingling apparatus for edge printing in a printing apparatus having an ink head and a line feeding motor feeding a sheet of printing paper in a paper advance direction includes a print setting unit setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes, and a controller controlling the line feeding motor to rotate by a step or a plurality of steps each corresponding to the width to print a first number of the edge regions of the printing paper using the nozzle sections according to the one of the shingling modes, and to print a second number of the edge regions of the printing paper using the nozzle sections according to another one of the shingling modes.

According to another aspect of the present invention, a shingling apparatus for edge printing in a printing apparatus having an ink head and a line feeding motor feeding a sheet of printing paper in a paper advance direction includes a print setting unit setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes, and a controller controlling the line feeding motor to rotate by a step or a plurality of steps each corresponding to the width to print a first number of the edge regions of the printing paper according to the one of the shingling modes and a second number of the edge regions of the printing paper according to another one of the shingling modes.

According to another aspect of the present invention, a shingling apparatus for front edge printing in a printing apparatus having an ink head and a line feeding motor feeding a sheet of printing paper in a paper advance direction includes a print setting unit setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes, and a controller controlling the line feeding motor to rotate by a step or a plurality of steps each corresponding to the width, and controlling a first number of the nozzle sections to discharge ink toward corresponding ones of the edge regions and a second number of nozzle sections not to discharge the ink toward corresponding ones of the edge regions according to a rotation of the line feeding motor by one of the step and the steps.

According to another aspect of the present invention, a shingling apparatus for front edge printing in a printing apparatus having an ink head and a line feeding motor feeding a sheet of printing paper in a paper advance direction includes a controller changing a first shingling mode to a second shingling mode according to a rotation of the line feeding motor.

BRIEF DESCRIPTION OF THE DRAWINGS

These and/or other aspects and advantages of the invention will become apparent and more readily appreciated from the following description of the preferred embodiments, taken in conjunction with the accompanying drawings of which:

FIG. 8A is a table illustrating the shingling method of FIGS. 7A through 7I;

FIG. 8B is a table illustrating another shingling method for front edge printing according to another embodiment of the present invention;

FIG. 8C is a table illustrating another shingling method for front edge printing according to another embodiment of the present invention;

FIG. 8D is a table illustrating another shingling method for front edge printing according to another embodiment of the present invention;

FIG. 9A is a table illustrating another shingling method for front edge printing according to another embodiment of the present invention;

FIG. 9B is a table illustrating another shingling method for front edge printing according to another embodiment of the present invention;

FIG. 10 is a table illustrating another shingling method for front edge printing according to another embodiment of the present invention;

FIG. 13A is a table illustrating the shingling method of FIGS. 12A through 12I;

FIG. 13B is a table illustrating another shingling method for back edge printing according to another embodiment of the present invention;

FIG. 13C is a table illustrating another shingling method for back edge printing according to another embodiment of the present invention;

FIG. 13D is a table illustrating another shingling method for back edge printing according to another embodiment of the present invention;

FIG. 14A is a table illustrating another shingling method for back edge printing according to another embodiment of the present invention;

FIG. 14B is a table illustrating another shingling method for back edge printing according to another embodiment of the present invention; and FIG. 15 is a table illustrating another shingling method for back edge printing according to another embodiment of the present invention.

DETAILED DESCRIPTION OF THE PREFERRED EMBODIMENTS

Figure 1:
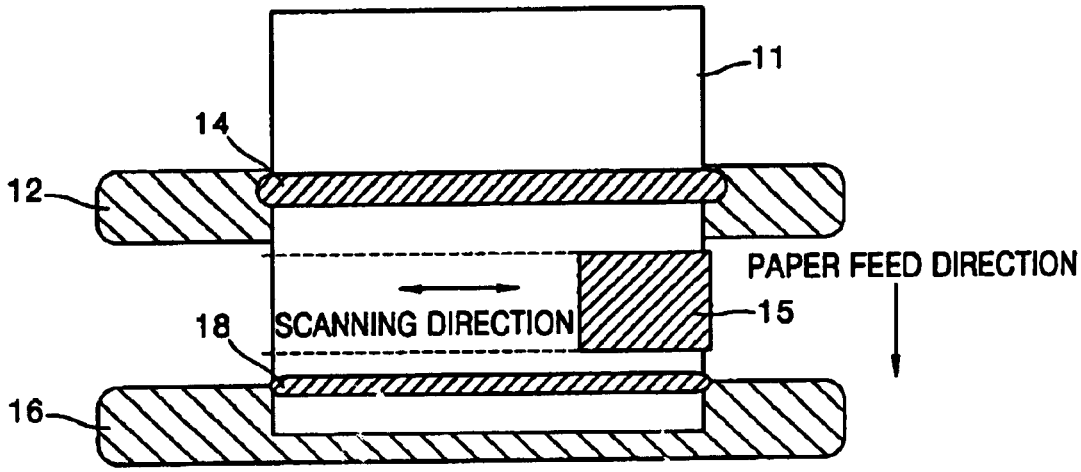
FIG. 1 (PRIOR ART)
FIG. 1 illustrates a conventional printing method in a conventional printing apparatus.
Figure 2:
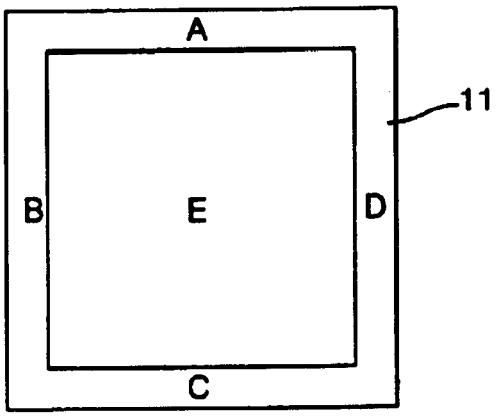
FIG. 2 (PRIOR ART)
FIG. 2 shows a printed region in a printing paper after printing using the conventional method of the conventional printing apparatus shown in FIG. 1.
Figure 3:
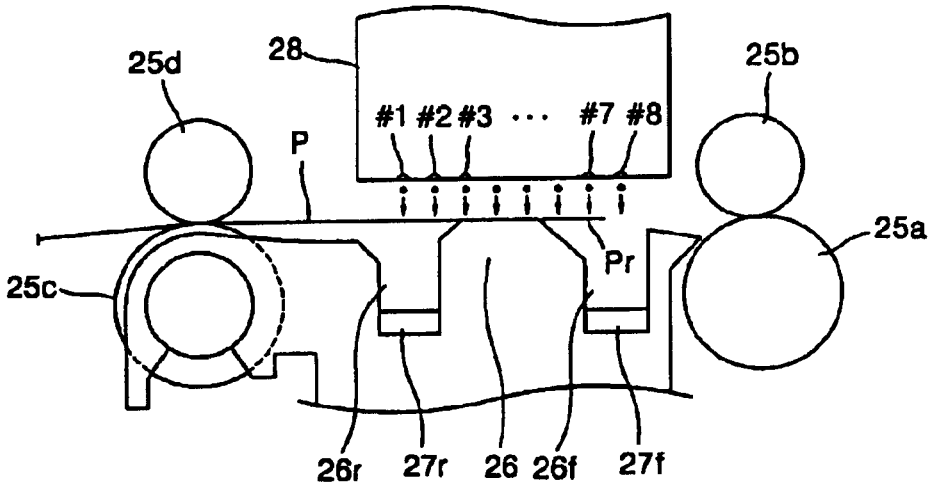
FIG. 3 (PRIOR ART)
FIG. 3 is a sectional view of another conventional printing apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

A shingling algorithm for printing in upper (front) and lower (bottom or rear) edges of a sheet of printing paper according to embodiments of the present invention will be described with reference to the appended drawings.

Figure 4:
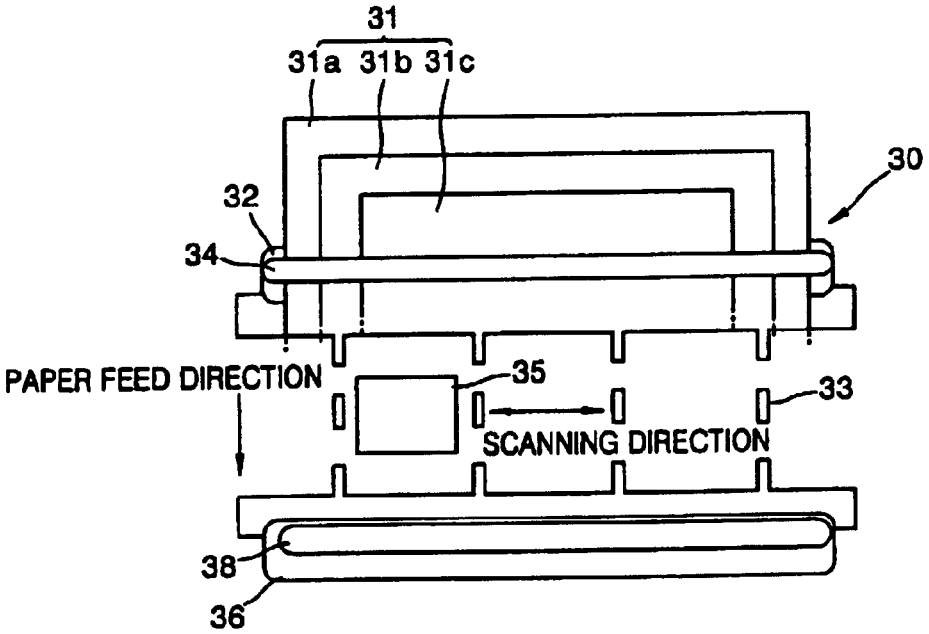
FIG. 4 shows a configuration of a printing apparatus compatible with a shingling algorithm according to an embodiment of the present invention.

FIG. 4 shows a configuration of a printing apparatus 30 capable of front and back edge printing using the shingling algorithm according to an embodiment of the present invention. Referring to FIG. 4, the printing apparatus 30 using the shingling algorithm includes a paper feed roller 32 and a pressure roller 34, which are disposed in an upper region (in FIG. 4) of the printing apparatus 30, to feed a sheet of printing paper 31 into the printing apparatus 30, and a paper exit roller 36 and a star wheel 38, which are disposed in a lower region of the printing apparatus 30, to exit the printing paper 31, after printing, from the printing apparatus 30. A plurality of ribs 33 are spaced at regular intervals between the paper feed roller 32 and the paper exit roller 36 such that ink droplets which do not reach the printing paper 31 fall into spaces between the ribs 33. An ink head 35 reciprocates in a scanning direction as indicated by arrows in FIG. 4, and discharges ink onto the printing paper 31 when a front edge of the printing paper 31 just reaches beneath the ink head 35 for printing.

The ribs 33 of the printing apparatus 30 are arranged in consideration of paper sizes of maximum, middle, and minimum widths of the printing papers 31 (31*a*, 31*b*, and 31*c*) that can be used in the printing apparatus 30, and each position of nozzles of the ink head 35, such that the ribs 33 are arranged at proper intervals both in rows and columns such that they do not match sides of the printing paper 31 of any size, for example, sides of the middle sized paper 31*b*, and such that outer nozzles of the ink head 35 are not covered by the ribs 33 so that the ink which does not reach the printing paper 31 falls into the spaces between the ribs 33. This arrangement of the ribs 33 is for preventing all of the four edges of the printing paper 31 from being contaminated by the ink dropping onto the ribs 33 during edge printing.

Figure 5:
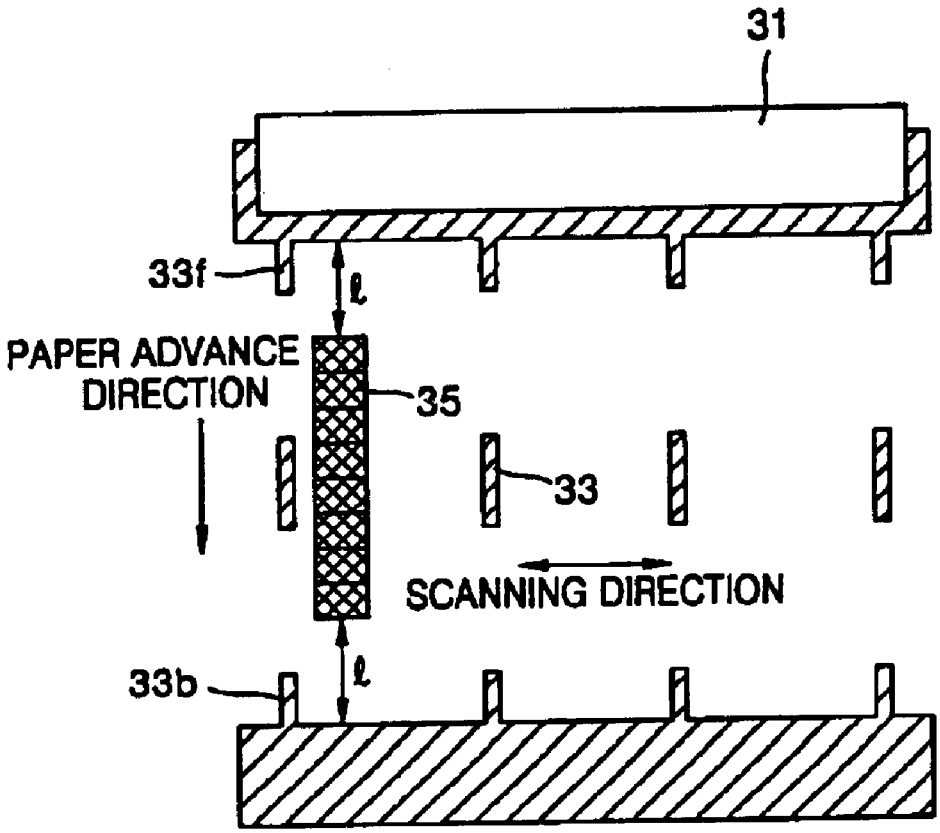
FIG. 5 shows an arrangement of an ink head and ribs for front and back edge printing using shingling methods performed in the printing apparatus shown in FIG. 4.

FIG. 5 shows arrangement of the ink head 35 and the ribs 33 for front and back edge printing using shingling methods performed in the printing apparatus 30 shown in FIG. 4.

Referring to FIG. 5, the ink head 35 is spaced a distance l from front and rear ribs 33*f* and 33*b* or main rib bodies having the front and rear ribs 33*f* and 33*b* protruding from the main rib bodies, respectively. The ribs 33 are spaced-apart from one another in horizontal and vertical directions for edge (borderless) printing as illustrated in FIG. 4. The ink head 35 is divided into eight nozzle sections designated, from a nearest one to a front end of the printing apparatus 30, as nozzle section 1, nozzle section 2, . . . , and nozzle section 8. As the printing paper 31 is advanced, the nozzle sections 1 through 8 are separately and appropriately controlled for the shingling printing.

"Shingling" refers to a printing technique of discharging a plurality of small ink droplets one at a time, instead of one large ink droplet, to print an image without ink burring. In shingling, sufficient temporal and spatial intervals are permitted between each ink discharge to allow previously discharged ink droplets to dry. In general, a smaller shingling mode index (expressed as n below) indicates smaller ink droplets and more head scanning, which produces high quality images.

Shingling method of front edge printing

Figure 6A:
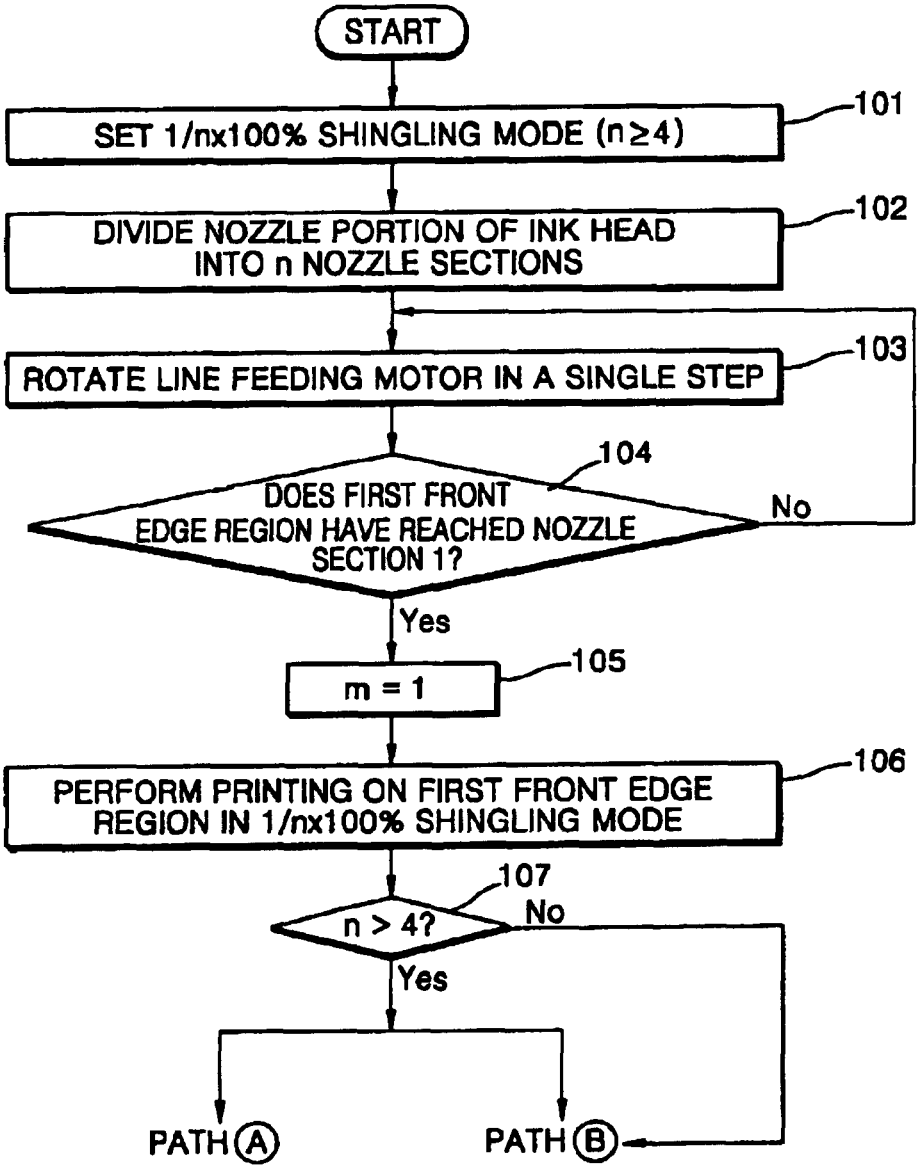
FIGS. 6A through 6C are flowcharts illustrating shingling methods for front edge printing performed in the printing apparatus shown in FIG. 4.
Figure 6B:
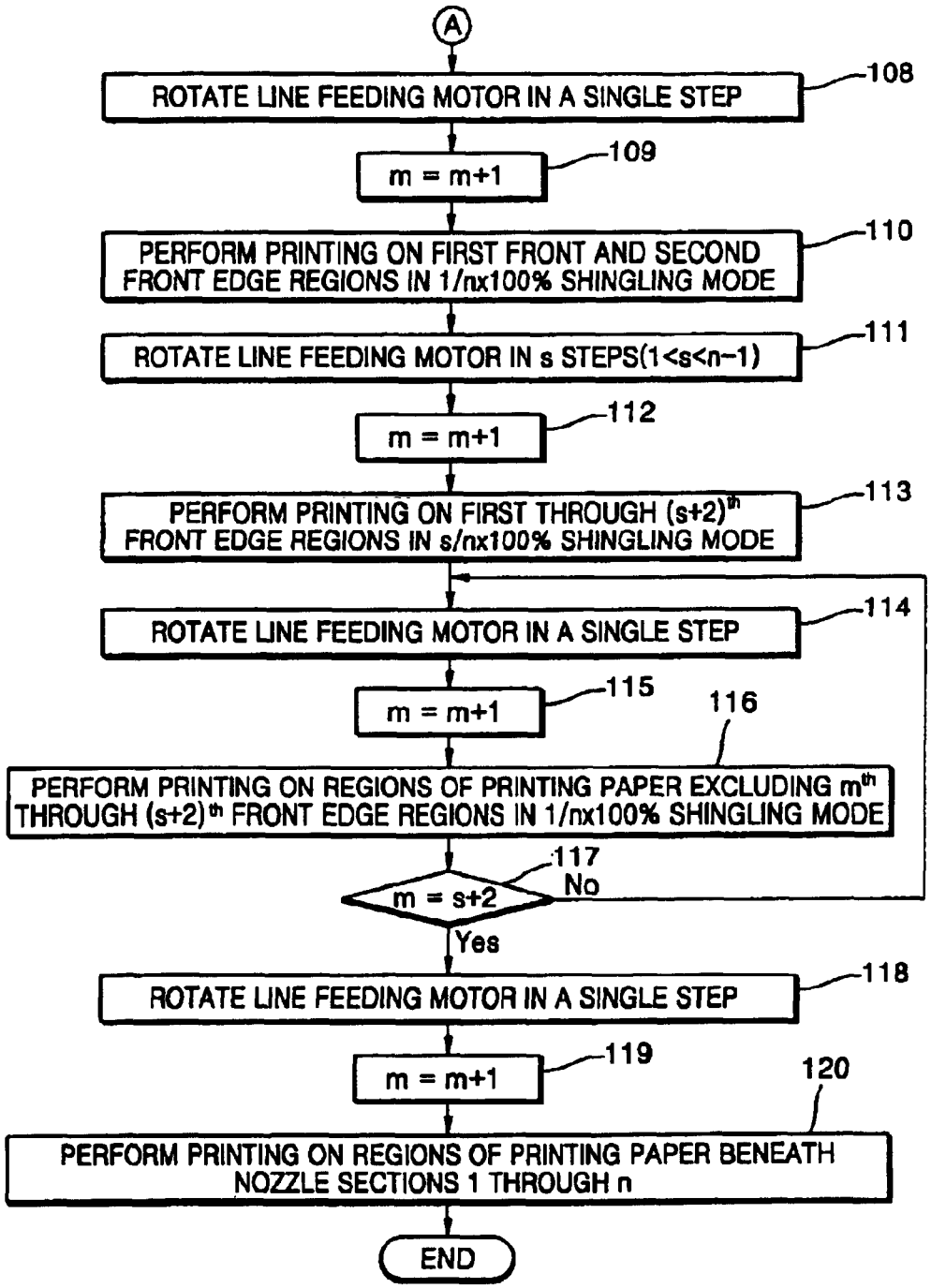
Figure 6C:
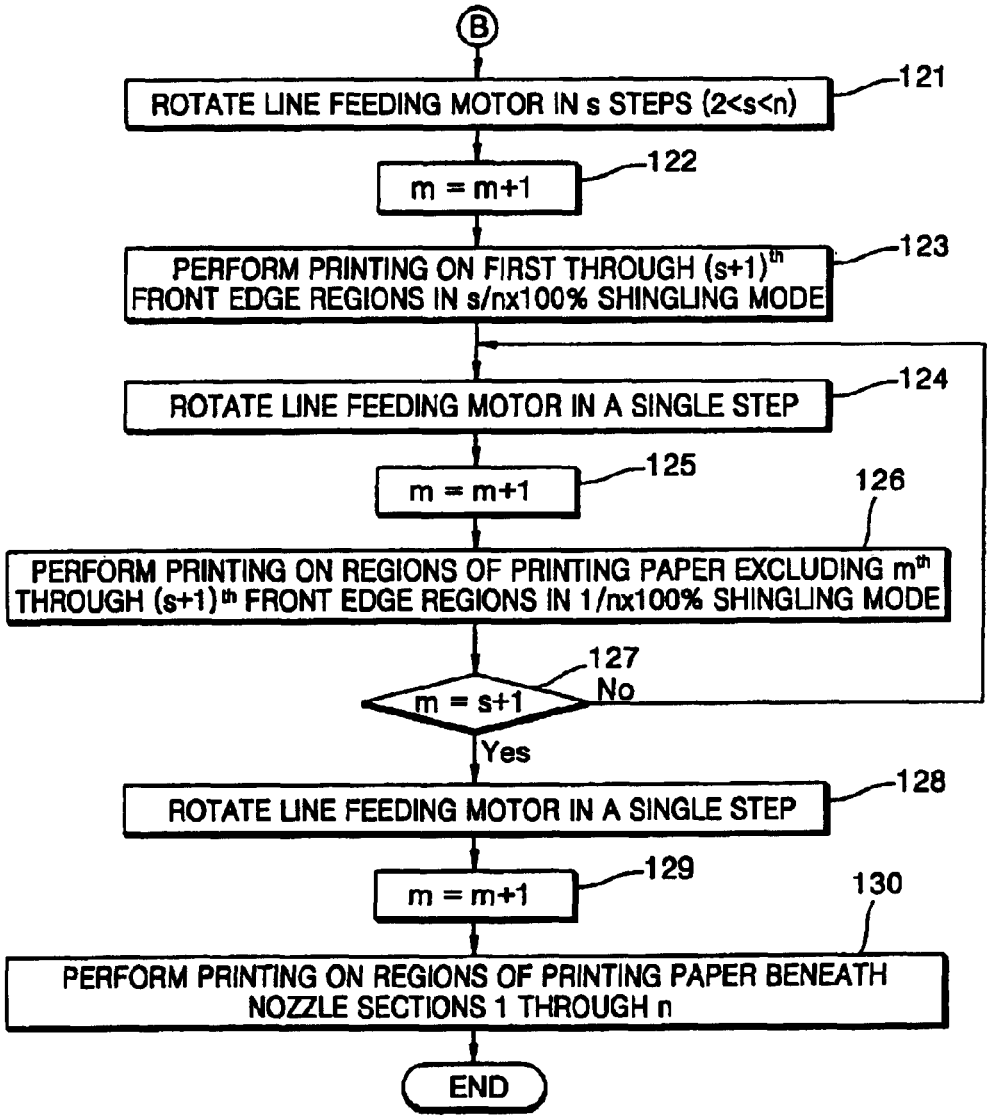

FIGS. 6A through 6C are flowcharts of shingling methods for front edge printing performed in the printing apparatus of FIG. 4.

Initially, a 1/n×100% shingling mode, where n is an integer greater than or equal to 4, is set as a default for front edge printing in operation 101. The ink head 35 is divided into n nozzle sections, including nozzle sections 1 through n, with an equal width in a paper advance direction in operation 102.

A width of each nozzle section in the paper advance direction is equivalent to a single step length by which a line feeding motor (paper transport motor) is rotated, and a unit paper advance distance by which the printing paper 31 is advanced as the paper transport motor is rotated one step length. The line feeding motor is rotated step by step according to the set shingling mode for printing in operation 103.

As the printing paper 31 is advanced and a first front edge region of the printing paper 31 reaches the nozzle section 1 in operation 104, a parameter m indicating the number of printing operations, is set to 1, and printing is performed on the first front edge region in the 1/n×100% shingling mode in operation 106. To end this, a sensor is attached to a bottom of the nozzle section 1 to detect arrival of the first front edge region of the printing paper 31 for printing initiation.

If the n of a shingling mode index, 1/n×100%, of the 1/n×100% shingling mode is greater than 4 in operation 107, either a path A or a path B may be provided for printing. If n is equal to 4, the path B is provided for printing. If n is greater than 4, various optional paths for front edge shingling printing are provided for a user to select a particular path when setting a printing environment, or the user is permitted to directly define a desired printing path.

In the path A, referring to FIG. 6B, the line feeding motor is rotated by a single step in operation 108, the parameter m is increased by 1 to be set to 2 in operation 109, the ink is discharged from the nozzle sections 1 and 2 to perform printing on the first and second front edge regions of the printing paper in the 1/n×100% shingling mode in operation 110.

Next, the line feeding motor is rotated in s steps, where s is an integer between 1 and n−1 in operation 111. It is possible that the s be an integer greater than n/2 in consideration of printing speed. After the line feeding motor is rotated in the s steps to advance the front edge region of the printing paper to an $(s+2)^{th}$ nozzle section, and the parameter m is increased by 1 and set to 3 in operation 112. Next, printing is performed on the first through $(s+2)^{th}$ front edge regions of the paper in the s/n×100% shingling mode in operation 113.

Next, the line feeding motor is rotated by a single step in operation 114, the parameter m is increased by 1 to be set to 4 (step 115), and printing is performed on the first through $(m-1)^{th}$ front edge regions and an $(s+3)^{th}$ front edge portion of the paper, excluding $m^{th}$ through $(s+2)^{th}$ front edge regions, in the 1/n×100% shingling mode in operation 116. For example, referring to FIG. 8B, when n=8 and s=4, after the printing paper 31 is advanced by the single step for printing with m=4, printing is performed on the front edge region of the paper excluding the fourth, fifth, and sixth front edge regions ④, ⑤, and ⑥ in a ⅛*100% shingling mode.

It is determined whether m=s+2 in operation 117. If m≠s+2, the line feeding motor is rotated by the single step, the printing is performed on the front edge region of the paper excluding the $m^{th}$ through $(s+2)^{th}$ front edge regions. The printing is continued in this manner until the parameter m becomes equal to s+2. If m=s+2, the process goes to a next step. For example, referring to FIG. 8B, when m=4, since the parameter m is not equal to s+2(=6), the line feeding motor is rotated by the single step. Next, the parameter m is increased by 1 and set to 5, and the printing is performed on the front edge region excluding the fifth and sixth front edge portions ⑤ and ⑥ in the ⅛*100% shingling mode. Since the parameter m is still not equal to 6, the line feeding motor is rotated further in the single step, the parameter m is increased by 1 and set to 6, the printing is performed on the front edge region of the paper excluding the sixth front edge region ⑥ in the ⅛*100% shingling mode. Since the parameter m is determined to be equal to s+2(=6) in operation 117, a process goes to a next operation.

Next, the line feeding motor is rotated in the single step in operation 118, m is increased by 1 in operation 119, and printing is performed on the regions of the paper beneath the nozzle sections 1 through n in the 1/n×100% shingling mode in operation 120. For example, referring to FIG. 8B, the line feeding motor is rotated by the single step to advance the third front edge portion ③ of the paper to line up beneath the nozzle section 35-8, the parameter m is increased by 1 and set to 7, and the printing is performed on the entire front edge region of the paper in the ⅛*100% shingling mode. Thus, the front edge printing in a shingling mode according to the path A is terminated.

The path B for the 1/n×100% front edge shingling printing when selected by the user or previously set with n>4, and when m=4 will be described with reference to FIG. 6C.

After printing on the first front edge region of the printing paper with m=1 in the 1/n×100% shingling mode and operation 107 of FIG. 6A, the line feeding motor is rotated by s steps, where s is an integer between 2 and n (2<s<n) in operation 121. It is possible that s be determined to be an integer greater than n/2 in consideration of the printing speed. Next, the parameter m is increased by 1 and set to 2 in operation 122, and the printing is performed on the first through $(s+1)^{th}$ front edge regions in the s/n×100% shingling mode in operation 123. For example, referring to FIG. 8C, when n=8 and s=7, after printing on the first front edge region ① with m=1 in the ⅛*100% shingling mode, the line feeding roller is rotated by 7 steps to advance the first front edge portion ① of the printing paper 31 to line up beneath the nozzle section 35-8, the parameter m is increased by 1 to be set to 2, and the printing is performed in a ⅞*100% shingling mode.

Next, the line feeding motor is rotated by the single step in operation 124, the parameter m is increased by 1 and set to 3 in operation 125, and the printing is performed on the regions of the printing paper 31 excluding the $m^{th}$ through $(s+1)^{th}$ front edge regions beneath the nozzle sections s and (m−1), i.e., $(m-1)^{th}$ and $(s+2)^{th}$ regions of the printing paper 31, in the 1/n×100% shingling mode in operation 126. For example, referring to FIG. 8C, the line feeding motor is rotated by the single step to advance the second front edge region ② to line up beneath the nozzle section 35-8, the parameter m is increased by 1 to be set to 3, and the printing is performed on the regions of the printing paper 31 excluding the third through eighth front edge regions ③ through ⑧, i.e., the second and ninth front edge regions ② and ③, in the ⅛*100% shingling mode.

Next, it is determined whether m=s+1 in operation 127. If m≠s+1, the process goes to operation 124 to rotate the line feeding motor by the single step. Next, the parameter m is increased by 1 to be set to 4, and the printing is performed on the regions of the printing paper 31 excluding the $m^{th}$ through $(s+1)^{th}$ front edge regions in the 1/n×100% shingling mode. These processes are repeated until the parameter m becomes equal to s+1. For example, referring to FIG. 8C, after printing with m=3, the parameter m is compared with s+1 (=8). Since the parameter m is not equal to 8, the line feeding motor is rotated by the single step, the parameter m is increased by 1 to be set to 4, the printing is performed on the regions of the printing paper 31 excluding the fourth through eighth front edge regions ④ through ⑧ in the ⅛*100% shingling mode. Since the parameter m is still not equal to s+1(=8), the process goes to operation 124 to repeat the printing until the parameter m becomes equal to 8.

When m=s+1, the line feeding motor is rotated in the single step in operation 128, the parameter m is increased by 1 in operation 129, and the printing is performed on the regions of the printing paper 31 beneath the nozzle sections 1 through n with m=s+2 in the 1/n×100% shingling mode in operation 130, thereby terminating the front edge printing in the shingling mode. For example, referring to FIG. 8C, after printing with m=8, the line feeding motor is rotated further by the single step, the parameter m is increased by 1 and set to 9, the printing is performed on the regions of the printing paper 31 beneath the nozzle sections 35-1 through 35-8 in the ⅛*100% shingling mode, thereby terminating the front edge printing through a total of 9 printing operations.

FIGS. 7A through 7I are views schematically illustrating the shingling method for front edge printing shown in FIGS. 6A through 6C where a 12.5% shingling mode is set as a default. In this shingling method, shingling printing is performed according to the path A as illustrated in FIGS. 6A and 6B.

Figure 7A:
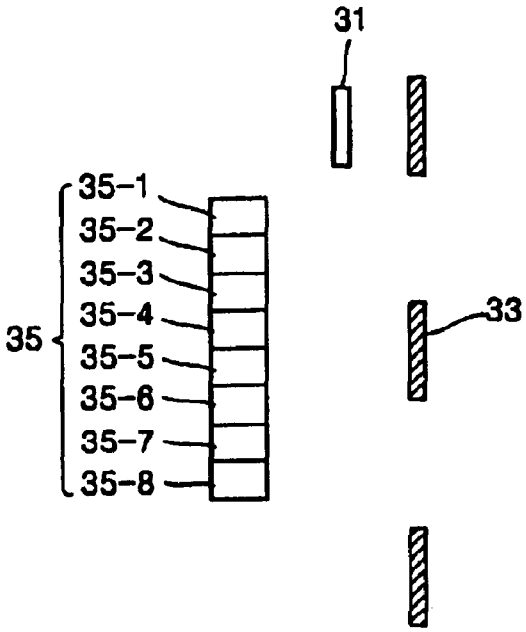
FIGS. 7A through 7I illustrate views showing the shingling method for front edge printing shown in FIGS. 6A through 6C.

Referring to FIG. 7A, the ink head 35 is divided into eight nozzle sections, denoted as 35-1, 35-2, 35-3, 35-4, 35-5, 35-6, 35-7, and 35-8, which will be hatched when the ink is discharged therefrom for printing. As shown in FIG. 7A, before the printing paper 31 reaches the ink head 35, the ink is not discharged from any of the nozzle sections of the ink head 35, so all of the nozzle sections are expressed as being blank and not hatched.

Figure 7B:
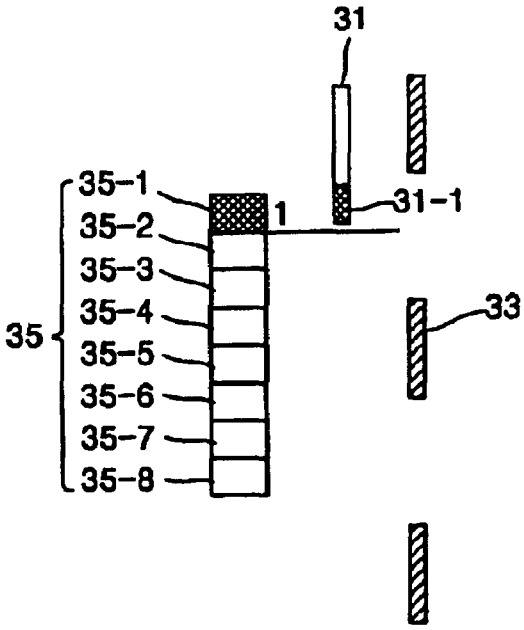

Referring to FIG. 7B, when the printing paper 31 reaches the ink head 35 by being transported by the line feeding motor (not shown), the ink is discharged from the nozzle section 35-1 onto the printing paper 31, wherein a portion of the ink drops into the space between the ribs 33. Since the ink is discharged only from the nozzle section 35-1, only the nozzle section 35-1 is hatched in FIG. 7B, and 1 is marked on the right of the nozzle section 35-1 to indicate that the shingling printing is performed at 12.5% (=⅛*100%).

Figure 7C:
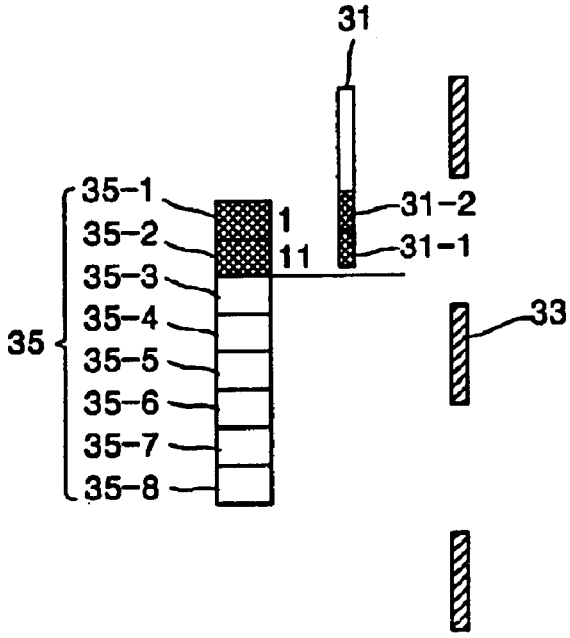

Next, when the printing paper 31 is advanced by the single step by the line feeding motor, as shown in FIG. 7C, the ink is discharged from the nozzle sections 35-1 and 35-2 of the ink head 35 in the 12.5% shingling mode. Since the first front edge region 31-1 of the printing paper 31 on which the 12.5% shingling printing has been undergone, has reached the nozzle section 35-2 as illustrated in FIG. 7B, 11 is marked on the right of the nozzle section 35-2 to indicate that a second shingling printing has been performed on the first front edge region 31-1 of the printing paper 31 at 12.5%. Also, the 1 is marked on the right of nozzle section 35-1 to indicate that a first shingling printing has been performed on the second front edge region 31-2 at 12.5%. At this stage of FIG. 7C, no ink is discharged from nozzle sections 35-3, 35-4, 35-5, 35-6, 35-7, and 35-8.

Figure 7D:
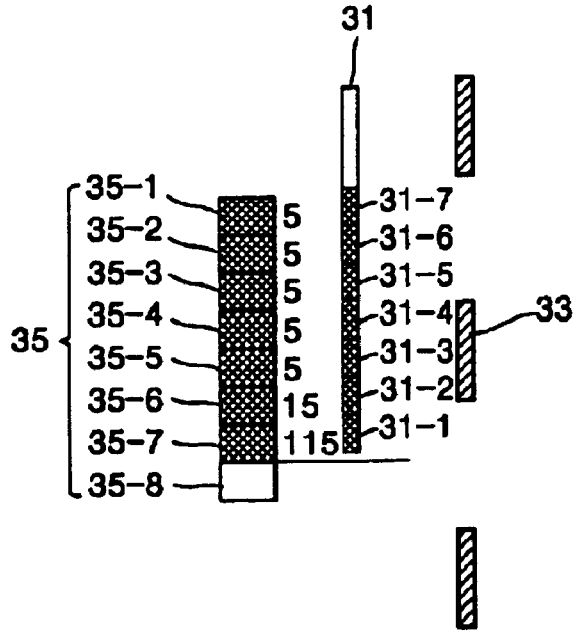

Next, as shown in FIG. 7D, the printing paper 31 is advanced five steps by the line feeding motor, and the ink is discharged from the nozzle sections 35-1, 35-2, 35-3, 35-4, 35-5, 35-6, and 35-7 onto the respective first through seventh front edge regions 31-1, 31-2, 31-3, 31-4, 31-5, 31-6, and 31-7 of the printing paper 31. Since the ink is discharged from the nozzle sections 35-1, 35-2, 35-3, 35-4, 35-5, 35-6, and 35-7 in a 62.5% (=⅝*100%) shingling mode, 5 is marked on the right of each of the nozzle sections. As a result, a total of 87.5% (=(1+1+5)/8*100) shingling printing is performed on the first front edge region 31-1 of the printing paper 31 that has reached the nozzle section 35-7. A total of 75% (=(1+5)/8*100%) shingling printing is performed on the second front edge region 31-2 of the printing paper 31 that has reached the nozzle section 35-6. A total of 62.5% shingling printing is performed on each of the third through seventh front edge regions 31-3 through 31-7 that have reached the respective nozzle sections 35-1, 35-2, 35-3, 35-4, and 35-5.

Figure 7E:
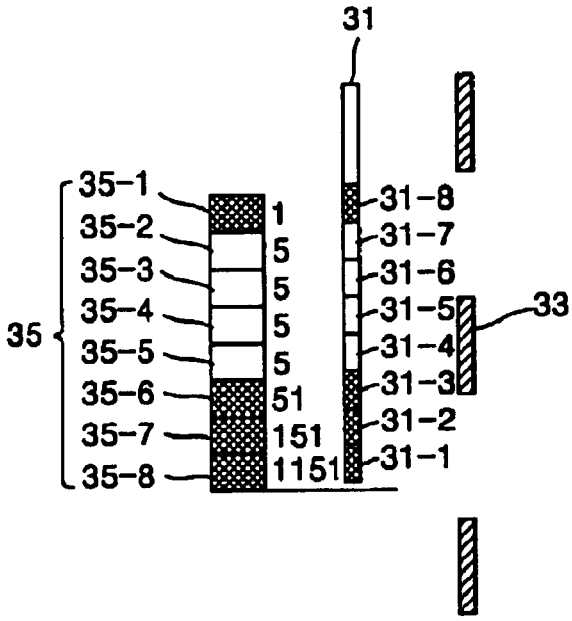

Referring to FIG. 7E, after the line feeding motor is rotated by the single step to advance the printing paper 31 to the nozzle section 35-8, the ink is discharged from the nozzle sections 35-1, 35-6, 35-7, and 35-8 in the 12.5% shingling mode. The nozzle sections 35-1, 35-6, 35-7, and 35-8 are hatched and are marked with 1 on the right thereof to indicate the discharge of the ink therefrom. As a result, a total of 100% (=(1+1+5+1)/8*100%) shingling printing is performed on the first front edge region 31-1 of the printing paper 31 that has reached the nozzle section 35-8. 87.5% (=(1+5+1)/8*100%) shingling printing is performed on the second front edge region 31-2 of the printing paper 31 that has reached the nozzle section 35-7, and 75% (=(5+1)/8*100%) shingling printing is performed on the third front edge region 31-3 of the printing paper 31 that has reached the nozzle section 35-6. In this operation, no ink is discharged from the nozzle sections 35-2, 35-3, 35-4, and 35-5, so that the shingling printing percentage of each of the fourth through seventh front edge regions 31-4, 31-5, 31-6, and 31-7 of the printing paper 31 that have reached the respective nozzle sections 35-2, 35-3, 35-4, and 35-5 remains at 62.5% that has been achieved at the previous stage of FIG. 7D. Also, the 12.5% shingling printing is performed on the eighth front edge region 31-8 of the printing paper 31 that has just reached the nozzle section 35-1.

Figure 7F:
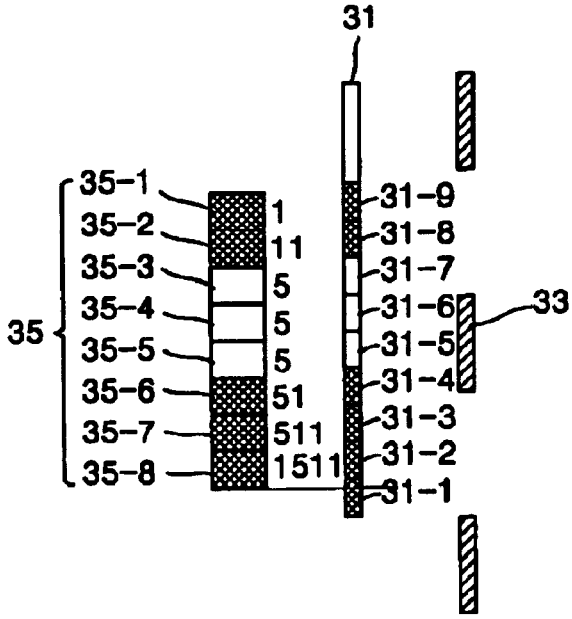

Next, referring to FIG. 7F, as the line feeding motor is rotated further in the single step to advance the printing paper 31, the first front edge region 31-1 of the printing paper 31 on which the 100% shingling printing has been undergone is drawn out and away from the ink head 35 toward the paper exit roller 36. The printing is performed on the second, third, fourth, eighth, and ninth front edge regions 31-2, 31-3, 31-4, 31-8, and 31-9 beneath the respective nozzle sections 35-8, 35-7, 35-6, 35-2, and 35-1 at the 12.5% shingling mode. Accordingly, in FIG. 7F, the nozzle sections 35-1, 35-2, 35-6, 35-7, and 35-8 are hatched and are marked with 1 on the right thereof to indicate that the 12.5% shingling printing is performed on the corresponding front edge regions thereof. As a result, a total of 12.5% shingling printing is performed on the ninth front edge region 31-9 of the printing paper 31 that has just reached the nozzle section 35-1, and a total of 25% (=(1+1)/8*100%) shingling printing is performed on the eighth front edge region 31-8 of the printing paper 31 that has reached the nozzle section 35-2. Also, the shingling printing percentage of regions of the printing paper 31 that have reached the respective third, fourth, and fifth sectors 35-3, 35-4, and 35-5 remains at 62.5% that has been achieved at the previous stage of FIG. 7E. A total of 75% (=(5+1)/8*100%) shingling printing is performed on the fourth front edge region 31-4 of the printing paper 31 that has reached the nozzle section 35-6, and a total of 87.5% (=(5+1+1)/8*100%) shingling printing is performed on the third front edge region 31-3 of the printing paper 31 that has reached the nozzle section 35-7.

A total of 100% (=(1+5+1+1)/8*100) shingling printing is performed on the second front edge region 31-2 of the printing paper 31 that has reached nozzle section 35-8, so that the second front edge region 31-2 is drawn out and away from the ink head 31 in FIG. 7F.

Figure 7G:
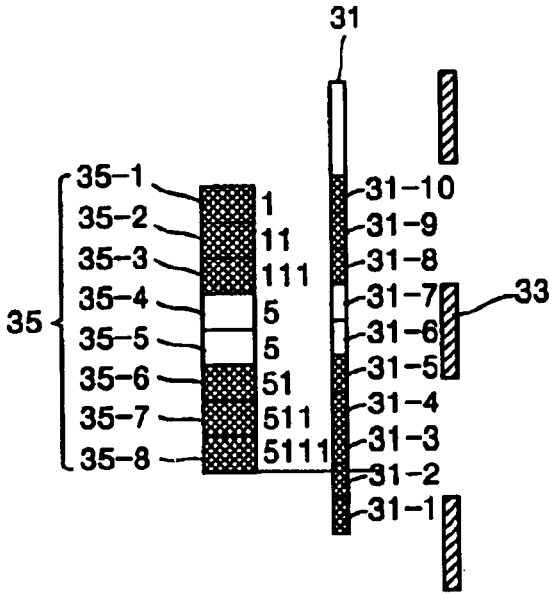

Next, referring to FIG. 7G, after the line feeding motor is rotated further by the single step to advance the printing paper 31, the ink is discharged from the nozzle sections 35-1, 35-2, 35-3, 35-6, 35-7, and 35-8 to perform the printing in the 12.5% shingling mode. As a result, a total of 12.5% shingling printing is performed on a tenth front edge region 31-10 of the printing paper 31 that has just reached the nozzle section 35-1, a total of 25% (=(1+1)/8*100%) shingling printing is performed on the ninth front edge region 31-9 that has reached the nozzle section 35-2, and a total of 37.5% (=(1+1+1)/8*100%) shingling printing is performed on the eighth front edge portion 31-8 that has reached the nozzle section 35-3. Also, the shingling printing percentage of each of the sixth and seventh front edge regions 31-6 and 31-7 that have reached the respective nozzle sections 35-5 and 35-4 remains at 62.5% that has been achieved at the previous stage of FIG. 7F. A total of 75% (=(5+1)/8*100%) shingling printing is performed on the fifth front edge region 31-4 of the printing paper 31 that has reached the nozzle section 35-6, and a total of 100% (=(5+1+1+1)/8*100%) shingling printing is performed on the third front edge region 31-3 of the printing paper 31 that has reached the nozzle section 35-8.

Figure 7H:
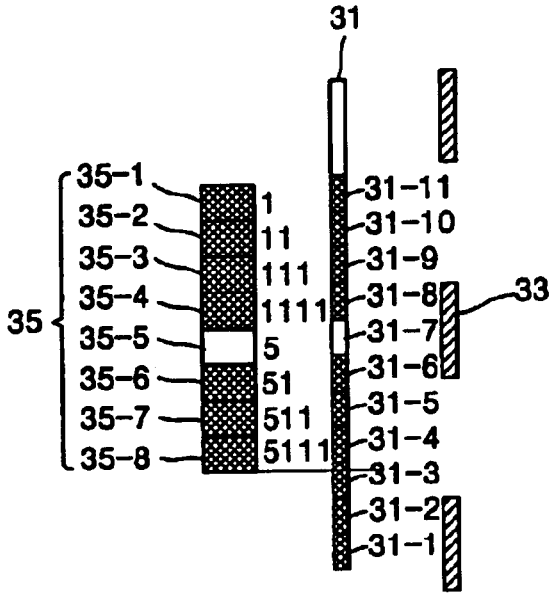

Referring to FIG. 7H, as the line feeding motor is rotated in the single step to advance the printing paper 31, the third front edge region 31-3 of the printing paper 31 is drawn out and away from the ink head 35. Next, the printing is performed on the fourth, fifth, sixth, eighth, ninth, tenth, and eleventh front edge regions 31-4, 31-5, 31-6, 31-8, 31-9, 31-10, and 31-11 that have reached the respective nozzle sections 35-8, 35-7, 35-6, 35-4, 35-3, 35-2, and 35-1 in the 12.5% shingling mode. No ink is discharged from the nozzle section 35-5, so that the shingling printing percentage of the seventh front edge region 31-7 remains at 62.5% that has been achieved at the previous stage, when the seventh front edge region had reached the nozzle section 35-1 in FIG. 7D. In the present embodiment, the seventh front edge region 31-7 of the printing paper 31 on which the printing has been once undergone when the seventh front edge region 31-7 just reaches the nozzle section 35-1, is expected not to be subject to additional printing before the seventh front edge region 31-7 reaches the nozzle section 35-6. As a result, a total of 12.5% shingling printing is performed on the eleventh front edge region 31-11 of the printing paper 31 that has reached the nozzle 35-1, a total of 25% (=(1+1)/8*100%) shingling printing is performed on the tenth front edge region 31-10 that has reached the nozzle section 35-2, a total of 37.5% (=(1+1+1)/8*100%) shingling printing is performed on the ninth front edge region 31-9 that has reached the nozzle section 35-3, a total of 50% (=(1+1+1+1)/8*100%) shingling printing is performed on the eighth front edge region 31-8 that has reached the nozzle section 35-4, a total of 75% (=(5+1)/8*100%) shingling printing is performed on the sixth front edge region 31-6 that has reached the nozzle section 35-6, a total of 87.5% (=(5+1+1)/8*100%) shingling printing is performed on the fifth front edge region 35-5 that has reached the nozzle section 35-7, and a total of 100% (=(5+1+1+1)/8*100%) shingling printing is performed on the fourth front edge region 31-4 that has reached the nozzle section 35-8.

Figure 7I:
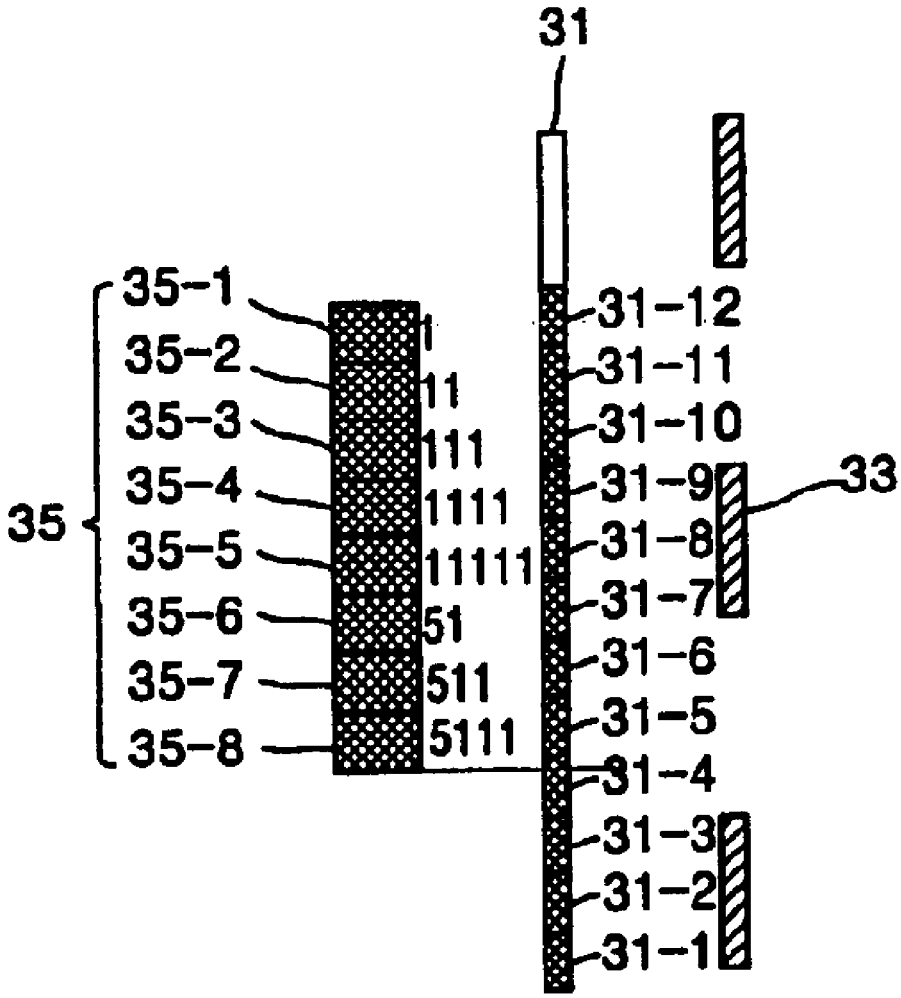

Referring to FIG. 7I, the fourth front edge region 31-4 of the printing paper 31 on which the 100% shingling printing has been undergone is drawn out and away from the ink head 35 toward the paper exit roller 36. As a result, a total of 100% shingling printing is performed on the fifth front edge region 31-5, a total of 87.5% shingling printing is performed on the sixth front edge region 31-6, and a total of 75% shingling printing is performed on the seventh front edge region 31-7, thereby terminating the front edge printing in the shingling mode. Next, the printing in the 12.5% shingling mode is continued for the following regions of the printing paper 31.

The front edge printing according to the present invention described with reference to FIGS. 7A through 7I is tabulated in FIG. 8A. In this table, rows denote the nozzle sections, and columns denote the number of printing operations performed, which corresponds to the parameter m described above. ⅛ and ⅝ denote 12.5% and 62.5% shingling modes, which can be represented as 1/n×100%, where n is the number of the nozzle sections. Numerals in circles denote respective sectional front edge regions of the printing paper 31.

When the line feeding motor is rotated step by step so that a front edge region of the printing paper 31 reaches the ink head 35, as shown in FIG. 7B and operation 104 of FIG. 6A, and the parameter m is set to 1, the printing is performed on the first front edge region ① of the printing paper 31 that has reached the nozzle section 35-1 of the ink head 35 in the 12.5% (=⅛*100%) shingling mode, as in operation 106 of FIG. 6A. When the line feeding motor is rotated to advance the printing paper 31by the single step, as in operation 108 of FIG. 6B, and m=2, the printing is performed on the first and second front edge regions ① and ② that have reached the respective nozzle sections 35-1 and 35-2 of the ink head 35 in the 12.5% (=⅛*100%) shingling mode, as in operation 110 of FIG. 6B.

After the line feeding motor is rotated in 5 (=s) steps so that the first front edge region ① is advanced to the nozzle section 35-7 (7=s+2), as in operation 111 of FIG. 6B, and the parameter m is set to 3, the ink is discharged from the nozzle sections 35-1, 35-2, 35-3, 35-4, 35-5, 35-6, and 35-7 to perform the printing on the first through seventh front edge regions ①, ②, ③, ④, ⑤, ⑥, and ⑦ in a 62.5% (=⅝*100%) mode, as in operation 113 of FIG. 6B. As a result of printing with m=3, a total of 87.5% shingling printing is performed on the first front edge region ①, and a total of 75% shingling printing is performed on the second front edge region ②, and a total of 62.5% shingling printing is performed on each of the third through seventh front edge regions ③, ④, ⑤, ⑥, and ⑦. For printing with m=4 or greater, the line feeding motor is rotated step by step, and the printing is performed constantly in the 12.5% shingling mode.

After the line feeding motor is rotated further by the single step, as in operation 114 of FIG. 6B, the printing is performed on the first, second, third, and eighth front edge regions ①, ②, ③, and ⑧ located beneath the respective nozzle sections 35-8, 35-7, 35-6, and 35-1 of the printing paper 31 excluding the fourth through seventh (corresponding to s+2) front edge regions ④, ⑤, ⑥, and ⑦, in the 12.5% (=⅛*100%) shingling mode, as in operation 116 of FIG. 6B. At this time, since the parameter m is not equal to s+2 (=7), the line feeding motor is rotated further by the single step.

Next, with m=5, the printing is performed on the second, third, fourth, eighth, and ninth front edge regions ②, ③, ④, ⑧, and ⑨ located beneath the respective nozzle sections 35-8, 35-7, 35-6, 35-2, and 35-1 in the 12.5% (=⅛*100%) shingling mode.

After the line feeding motor is rotated further by the single step, and with m=6, the printing is performed on the third, fourth, fifth, eighth, ninth, and tenth front edge regions ③, ④, ⑤, ⑧, ⑨, and ⑩ located beneath the respective nozzle sections 35-8, 35-7, 35-6, 35-3, 35-2, and 35-1 in the 12.5% (=⅛*100%) shingling mode.

After the line feeding motor is rotated further by the single step, and with m=7, the printing is performed on the fourth, fifth, sixth, eighth, ninth, tenth, and eleventh front edge regions ④, ⑤, ⑥, ⑧, ⑨, ⑩, and ⑪ located beneath the respective nozzle sections 35-8, 35-7, 35-6, 35-3, 35-2, and 35-1 in the 12.5% (=⅛*100%) shingling mode.

As a result of printing with m=7, the shingling printing is performed on the eighth, ninth, tenth, and eleventh front edge regions ⑧, ⑨, ⑩, and ⑪ located beneath the respective nozzle sections 35-4, 35-3, 35-2, and 35-1 at different percentages, i.e., 50%, 37.5%, 25%, and 21.5%, respectively. Also, the shingling printing is performed on the seventh front edge region ⑦ located beneath the nozzle section 35-5 at 62.5%, the sixth front edge region ⑥ located beneath the nozzle section 35-6 at 75%, and the fifth front edge region ⑤ located beneath the nozzle section 35-7 at 82.5%. The s shingling printing is performed on the fourth front edge region ④ located beneath the nozzle section 35-8 at 100%.

After printing with m=7, which is equal to s+2, the line feeding motor is rotated further by the single step, the parameter m is set to 8, and the printing is performed on regions of the paper located beneath the nozzle sections 35-1 through 35-8 in the 12.5% shingling mode, thereby terminating the front edge printing in the shingling mode. For printing with m=9 or greater, the line feeding motor is rotated step by step, and the printing is performed constantly in the 12.8% shingling mode. Alternatively, the printing may be stopped.

FIG. 8B is a table illustrating another shingling method for front edge printing according to another embodiment of the present invention where the 12.5% shingling mode is set as a default. Unlike the shingling method shown in FIG. 8A, for printing with m=3, the line feeding motor is rotated to advance the printing paper 31 four steps. In this method, the printing is performed according to the path A of FIGS. 6A and 6B.

Referring to FIG. 8B, when m=1 and m=2, the printing is performed on the first front edge region ① and the first and second front edge regions ① and ②, respectively, in the 12.5% shingling mode, as shown in FIG. 8A. Next, for printing with m=3, the line feeding motor is rotated by the 4 (=s) steps to advance the first front edge region ① to line up beneath the nozzle section 35-6 (6=s+2), and the printing is performed on the first, second, third, fourth, fifth, and sixth front edge regions ①, ②, ③, ④, ⑤, and ⑥ located beneath the respective nozzle sections 35-6, 35-5, 35-4, 35-3, 35-2, and 35-1 in a 50% (=⅜*100%) shingling mode.

After the line feeding motor is rotated further by the single step, and with m=4, the printing is performed on the first, second, third, and seventh front edge regions ①, ②, ③, and ⑦ located beneath the respective nozzle sections 35-7, 35-6, 35-5, and 35-1, excluding the fourth, fifth, and sixth front edge regions ④, ⑤, and ⑥, in the 12.5% (=⅛*100%) shingling mode. At this time, since the parameter m is not equal to s+2(=6), the line feeding motor is rotated further by the single step to continue printing in the 12.5% shingling mode.

With m=5, the printing is performed on the first, second, third, fourth, seventh, and eighth front edge regions ①, ②, ③, ④, ⑦, and ⑧ located beneath the respective nozzle sections 35-8, 35-7, 35-6, 35-5, 35-2, and 35-1 in the 12.5% shingling mode. As a result of printing with m=5, a total of 100% shingling printing is performed on the first front edge region ①, and thus the first front edge region ① is drawn out and away from the ink head 35 as the line feeding motor is rotated for further printing.

After the line feeding motor is rotated further by the single step, and with m=6, the printing is performed on the second, third, fourth, fifth, seventh, eighth, and ninth front edge regions ②, ③, ④, ⑤, ⑦, ⑧, and ⑨ located beneath the respective nozzle sections 35-8, 35-7, 35-6, 35-5, 35-3, 35-2, and 35-1, excluding the sixth front edge region ⑥, in the 12.5% (=⅛*100%) shingling mode. At this time, since m=6(=s+2), after the line feed motor is rotated further by the single step, and with m=7, the printing is performed on all regions of the printing paper 31 beneath the nozzle sections 35-8, 35-7, 35-6, 35-5, 35-4, 35-3, 35-2, and 35-1 in the 12.5% (=⅛*100%) shingling mode.

FIG. 8C is a table illustrating another shingling method for front edge printing according to another embodiment of the present invention where the 12.5% shingling mode is set as a default. In this method, the printing is performed according to the path B of FIGS. 6A and 6C.

Referring to FIG. 8C, after the first front edge region ① of the printing paper 31 is advanced to be directly beneath the nozzle section 35-1 of the ink head 35, as in operation 104 of FIG. 6A, and m=1, the printing is performed on the first front edge region ① in the 12.5% shingling mode, as in operation 106 of FIG. 6A. After the line feeding motor is rotated by 7 (=s) steps, as in operation 121 of FIG. 6C, to advance the first front edge region of the printing paper 31 to line up beneath the nozzle section 35-8, and the parameter m is set to 2, the printing is performed on the first through eight front edge regions ① through ⑧ in a 82.5% (=⅞*100%) shingling mode, as in operation 123 of FIG. 6C. As a result of printing with m=2, the shingling printing is performed on the first front edge region ① at 100% and the second through eighth front edge regions ② through ⑧ at 82.5%.

After the line feeding motor is rotated further by the single step, as in operation 124 of FIG. 6C, and with m=3, the printing is performed on the second and ninth front edge regions ② and ⑨ that have been advanced to be directly beneath the respective nozzle sections 35-8 and 35-1, excluding the third through eighth front edge regions ③ through ⑧, in the 12.5% (=⅛*100%) shingling mode, as in operation 126 of FIG. 6C. At this time, since the parameter m is not equal to s+1 (=8), the line feeding motor is rotated further by the single step.

With m=4, the printing is performed on the third, ninth, and tenth front edge regions ③, ⑨, and ⑩ located beneath the respective nozzle sections 35-8, 35-2, and 35-1 in a 12.5% (=⅛*100%) shingling mode. The printing in the 12.5% shingling mode is continued in this manner until the parameter m becomes equal to s+1(=8).

After printing with m=8, the line feeding motor is rotated further by the single step, as in operation 128 of FIG. 6C, the printing is performed on the regions ⑧ through ⑮ of the paper located beneath all of the nozzle sections 35-1, 35-2, 35-3-35-4, 35-5, 35-6, 35-7, and 35-8 in the 12.5% shingling mode, as in operation 130 of FIG. 6C, thereby terminating the front edge printing in the shingling mode through a total of 9 printing operations.

FIG. 8D is a table illustrating another shingling method for front edge printing according to another embodiment of the present invention where the 12.5% shingling mode is set as a default. In this shingling method, the shingling printing is performed according to the path B of FIGS. 6A and 6C.

Referring to FIG. 8D, after the first front edge region ① of the printing paper 31 is advanced to be directly beneath the nozzle section 35-1 of the ink head 35, as in the shingling method shown in FIGS. 8A through 8C, and the parameter m is set to 1, the printing is performed on the first front edge region ① in the 12.5% shingling mode. After the line feeding motor is rotated by 6 (=s) steps, as in operation 121 of FIG. 6C, to advance the first front edge region ① of the printing paper to line up beneath the nozzle section 35-7, and the parameter m is set to 2, printing is performed on the first through eight front edge regions ① through ⑦ located beneath the respective nozzle sections 35-7 through 35-1 in a 75% (=⅝*100%) shingling mode, as in operation 123 of FIG. 6C.

The line feeding motor is rotated step by step for printing with the parameter m from 3 to 7, as in operation 124 of FIG. 6C, and the printing is recursively performed on the regions of the printing paper 31 beneath the nozzle sections 1 through (m−2), 7 and 8 in the 12.5% shingling mode, as in operation 126 of FIG. 6C. When m=8, the printing is performed on the regions of the printing paper beneath all of nozzle sections 35-1 through 35-8 in the 12.5% shingling mode, as in operation 130 of FIG. 6C.

FIG. 9A is a table illustrating another shingling method for front edge printing according to another embodiment of the present invention where a 20% shingling mode is set as a default. Since the 20% shingling mode is set as the default, the ink head 35 is divided into 5 nozzle sections and designated as 45-1, 45-2, 45-3, 45-4, and 45-5, from the one closest to the front end of the ink head 35. In this embodiment, the shingling printing is performed according to the path B of FIGS. 6A and 6C.

Referring to FIG. 9A, when the first front edge region ① of the printing paper 31 is advanced to be directly beneath the nozzle section 45-1 of the ink head 35, the parameter m is set to 1, and the printing is performed on the first front edge region ① in the 20% shingling mode. After the line feeding motor is rotated by 3 (=s) steps to advance the first front edge region ① of the printing paper 31 to line up beneath the nozzle section 45-4, and the parameter m is set to 2, the printing is performed on the first through fourth front edge regions ① through ④ located beneath the respective nozzle sections 45-4 through 45-1 in a 60% (=⅗*100%) shingling mode.

The line feeding motor is rotated step by step for printing with m≧3. When m=3, the printing is performed on the first, second, and fifth front edge regions ①, ②, and ⑤ beneath the respective nozzle sections 45-5, 45-4, and 45-1 in the 20% (=⅕*100%) shingling mode. When m=4, the printing is performed on the second, third, fifth, and sixth front edge regions ②, ③, ⑤ and ⑥ beneath the respective nozzle sections 45-5, 45-4, 45-2, and 45-1 in the 20% (=⅕*100%) shingling mode. When m=5 or greater, the printing is performed on the regions of the printing paper 31 beneath all of the nozzle sections 45-5 through 45-1 in the 20% shingling mode.

FIG. 9B is a table illustrating another shingling method for front edge printing according to another embodiment of the present invention where the 20% shingling mode is set as a default. In this method, the shingling printing is performed according to the path B of FIGS. 6A and 6C.

Referring to FIG. 9B, when the first front edge region ① of the printing paper 31 is advanced to be directly beneath the nozzle section 45-1 of the ink head 35, the parameter m is set to 1, and the printing is performed on the first front edge region ① in the 20% (=⅕*100%) shingling mode. After the line feeding motor is rotated by 4 (=s) steps to advance the first front edge region ① of the printing paper 31 to line up beneath the nozzle section 45-5, and the parameter m is set to 2, the printing is performed on the first through fifth front edge regions ① through ⑤ located beneath respective nozzle sections 45-5 through 45-1 in a 80% (=⅘*100%) shingling mode.

The line feeding motor is rotated further by the single step, and when m=3, the printing is performed on the second and sixth front edge regions ② and ⑥ beneath the respective nozzle sections 45-5 and 45-1 in the 20% (=⅕*100%) shingling mode. The line feeding motor is rotated further by the single step, and when m=4, the printing is performed on the third, sixth, and seventh front edge regions ③, ⑥, and ⑦ beneath the respective nozzle sections 45-5, 45-2, and 45-1 in the 20% (=⅕*100%) shingling mode. The line feeding motor is rotated further in the single step, and when m=5, the printing is performed on the fourth, sixth, seventh, and eighth front edge regions ④, ⑥, ⑦ and ⑧ beneath the respective nozzle sections 45-5, 45-3, 45-2, and 45-1 in the 20% (=⅕*100%) shingling mode. For printing with m=6 or greater, the line feeding motor is rotated step by step, and the printing is performed on the regions of the printing paper 31 beneath all of the nozzle sections 45-1 through 45-5 constantly in the 20% shingling mode.

FIG. 10 is a table illustrating another shingling method for front edge printing according to another embodiment of the present invention where the 25% shingling mode is set as a default. In this embodiment, the shingling printing is performed according to the path B of FIGS. 6A and 6C with n=4.

Referring to FIG. 10, when the first front edge region ① of the printing paper 31 is advanced to be directly beneath a nozzle section 55-1 of the ink head 35 as the line feeding motor is continuously rotated step by step, the parameter m is set to 1, and the printing is performed on the first front edge region ① in a 25% (=¼*100%) shingling mode. After the line feeding motor is rotated by 3 (=s) steps to advance the first front edge region ① of the printing paper 31 to line up beneath a nozzle section 55-4, and the parameter m is set to 2, the printing is performed on the first through fourth front edge regions ① through ④ located beneath the respective nozzle sections 55-4 through 55-1 in a 75% (=¾*100%) shingling mode. As a result of printing with m=2, the shingling printing is performed on the first front edge region ① at 100%.

The line feeding motor is rotated further by the single step so that the first front edge region ① is drawn out and away from the ink head 35, and the second and fifth front edge regions ② and ⑤ line up beneath the respective nozzle sections 55-4 and 55-1. After the parameter m is increased to 3, the printing is performed on the second and fifth front edge regions ② and ⑤ in the 25% (=¼*100%) shingling mode.

The line feeding motor is rotated further by the single step, and the parameter m is increased to 4, the printing is performed on the third, fifth, and sixth front edge regions ③, ⑤, and ⑥ beneath the respective nozzle sections 55-4, 55-2, and 55-1 in the 25% (=¼*100%). For printing with m=5 or greater, the line feeding motor is rotated step by step, and the printing is performed on the regions of the printing paper 31 beneath all of the nozzle sections 55-1 through 55-4 constantly in the 25% (=¼*100%) shingling mode.

Shingling method of back edge printing

FIGS. 11A through 11D are flowcharts of shingling methods of back edge printing performed in the printing apparatus shown in FIG. 4.

Initially, the 1/n×100% shingling mode, where n is an integer greater than or equal to 4, is set as a default for back edge printing in operation 201. The ink head 35 is divided into n nozzle sections, including nozzle sections 1 through n, with an equal width in a paper advance direction in operation 202.

Figure 12A:
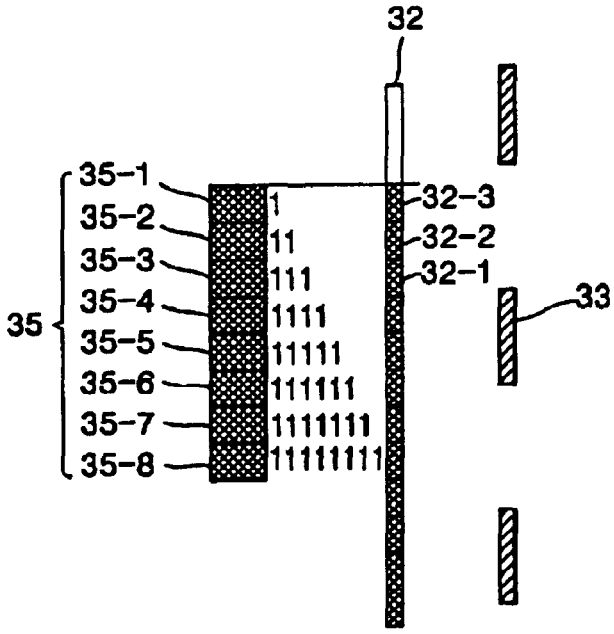
FIGS. 12A through 12I illustrate views of the shingling method for back edge printing shown in FIGS. 11A through 11D.

A width of each nozzle section in the paper advance direction is equivalent to a single step length by which the line feeding motor is rotated, and a unit paper advance distance by which a sheet of printing paper 32 of FIG. 12A is advanced as the paper transport motor is rotated one step length.

A first back edge region of the printing paper 32 that is separated from the back edge of the printing paper 32 by a distance corresponding to the entire width of the ink head 35 is defined in operation 203. The line feeding motor is rotated step by step according to the set shingling mode to advance the printing paper for printing in operation 204.

Whether the first back edge region has reached a nozzle section r is determined using a sensor attached to each of the nozzle sections of the ink head 35 or a distance from the front edge of the printing paper 32 to the first back edge region that is previously set for the printing paper 32 having different sizes in operation 205). When the first back edge region has reached the nozzle section r, the parameter m is set to 1 to start the back edge printing in operation 206.

Printing is performed on regions of the printing paper 32 located beneath the ink head 35 excluding the first back edge region in the 1/n×100% shingling mode in operation 207. The line feeding motor is rotated by the signal step in operation 208, the parameter m is increased by 1 to be set to 2 for next printing in operation 209. For example, referring to FIG. 13A, when the first back edge region ① reaches the nozzle section 35-4 (r=4), the printing is performed on regions of the printing paper 32 located beneath the ink head 35 excluding the first back edge region ① in the ⅛*100% shingling mode. Next, the line feeding motor is rotated further by the single step, and the parameter m is set to 2.

Next, it is determined whether m=n−r+1 in operation 210. If m≠n−r+1, the process goes to operation 207 to perform printing on regions of the printing paper 32 beneath the ink head 35 excluding the first through $m^{th}$ back edge regions in the 1/n×100% shingling mode. If m=n−r+1, the printing is performed on the first through nth back edge regions of the printing paper 32 in an m/n×100% shingling mode in operation 211. Next, it is determined whether r>2. If r>2, the process goes to the path A or path B.

For example, referring to FIGS. 13A and 13B, when m=2, since the parameter m is not equal to n−r+1(=5), the printing is performed on regions of the printing paper 32 beneath the ink head 35 excluding the first and second back edge regions ① and ② in the ⅛*100% shingling mode, the line feeding motor is rotated further by the single step, and the parameter m is increased to 3. Since m≠5, the process goes to operation 207, and the printing is performed on regions of the printing paper 32 beneath the ink head 35 excluding the first, second, and third back edge regions ①, ②, and ③ in the ⅛*100% shingling mode. The line feeding motor is rotated further by the single step, and the parameter m is increased to 4. Since m≠5, the process goes to operation 207, and the printing is performed on regions of the printing paper 32 beneath the ink head 35 excluding the first, second, third, and fourth back edge regions ①, ②, ③, and ④ in the ⅛*100% shingling mode. The line feeding motor is rotated further by the single step, and the parameter m is increased to 5. Since m=5, the ink is discharged from all of the nozzle sections 35-1, 35-2, 35-3, 35-4, 35-5, 35-6, 35-7, and 35-8 in order to perform printing on the first through eight back edge regions ① through ⑧ in a ⅝*100% shingling mode.

If it is determined in operation 212 that r=2, the process goes to the path C. A particular path may be designated by a user or may be previously set in the printing apparatus.

In the path A, the line feeding motor is rotated further by the single step in operation 213, the parameter m is increased by 1 in operation 214, and the printing is performed on the $m^{th}$ and $n^{th}$ back edge regions in the 1/n×100% shingling mode in operation 215. The line feeding motor is rotated by (n−r+1) steps in operation 216 to draw regions of the printing paper 32 on which the 100% shingling printing has been undergone, out and away from the ink head 35. Next, the parameter m is increased by 1 in operation 217, and printing is performed on the $m^{th}$ through $n^{th}$ back edge regions of the printing paper 32 in the 1/n×100% shingling mode in operation 218. Next, it is determined whether m=n in operation 219. If m=n, the back edge printing in the shingling mode is terminated. If m<n, the line feeding motor is rotated further by the single step in operation 220, and the process goes to operation 217, where the parameter m is increased by 1, and the printing is performed on the $m^{th}$ through $n^{th}$ back edge regions of the printing paper 32 in the 1/n×100% shingling mode in operation 215.

For example, referring to FIG. 13B, after printing with m=5, the line feeding motor is rotated by the single step so that the first back edge region ① is drawn out and away from the ink head 35, and the second and eight back edge regions ② and ⑧ are advanced to the respective nozzle sections 35-8 and 35-2. Next, with m=6, the printing is performed only on the sixth, seventh, and eighth back edge regions ⑦, ⑧, and ⑨ in the ⅛*100% shingling mode. The line feeding motor is rotated by 5 (=n−r+1) steps to draw the second through sixth back edge regions ② through ⑥ out and away from the ink head 35. Next, the parameter m is increased to 7, and the printing is performed on the seventh and eighth back edge regions ⑦ and ⑧ in the ⅛*100% shingling mode. Since the parameter m (=7) is smaller than n (=8), the light feeding motor is rotated further by the single step, the parameter m is increased to 8, and the printing is performed on the eighth back edge region ⑧ in the ⅛*100% shingling mode. Since m=n, the back edge printing in the shingling mode is terminated.

Figure 11A:
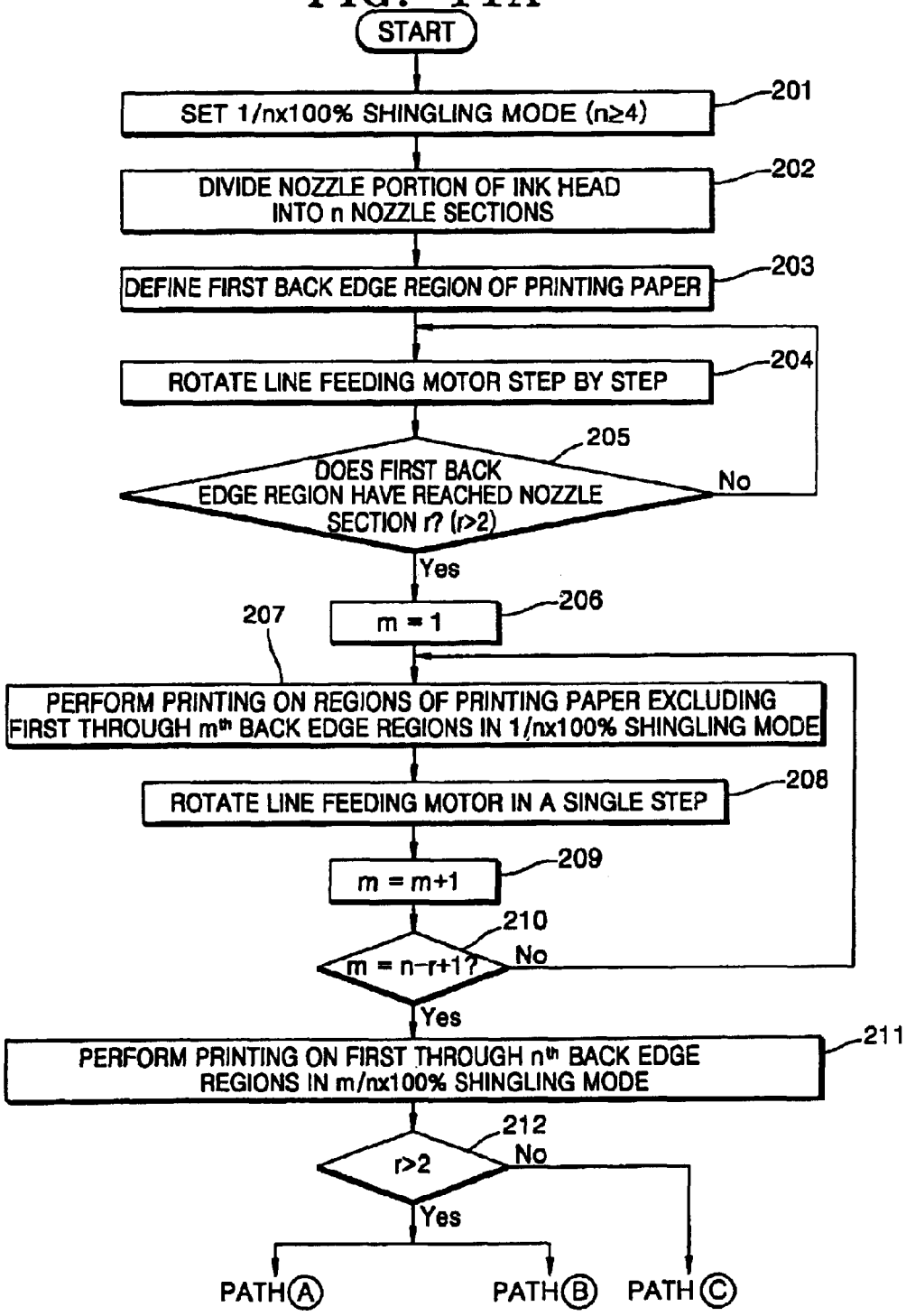
FIGS. 11A through 11D are flowcharts illustrating other shingling methods for back edge printing performed in the printing apparatus shown in FIG. 4.
Figure 11B:
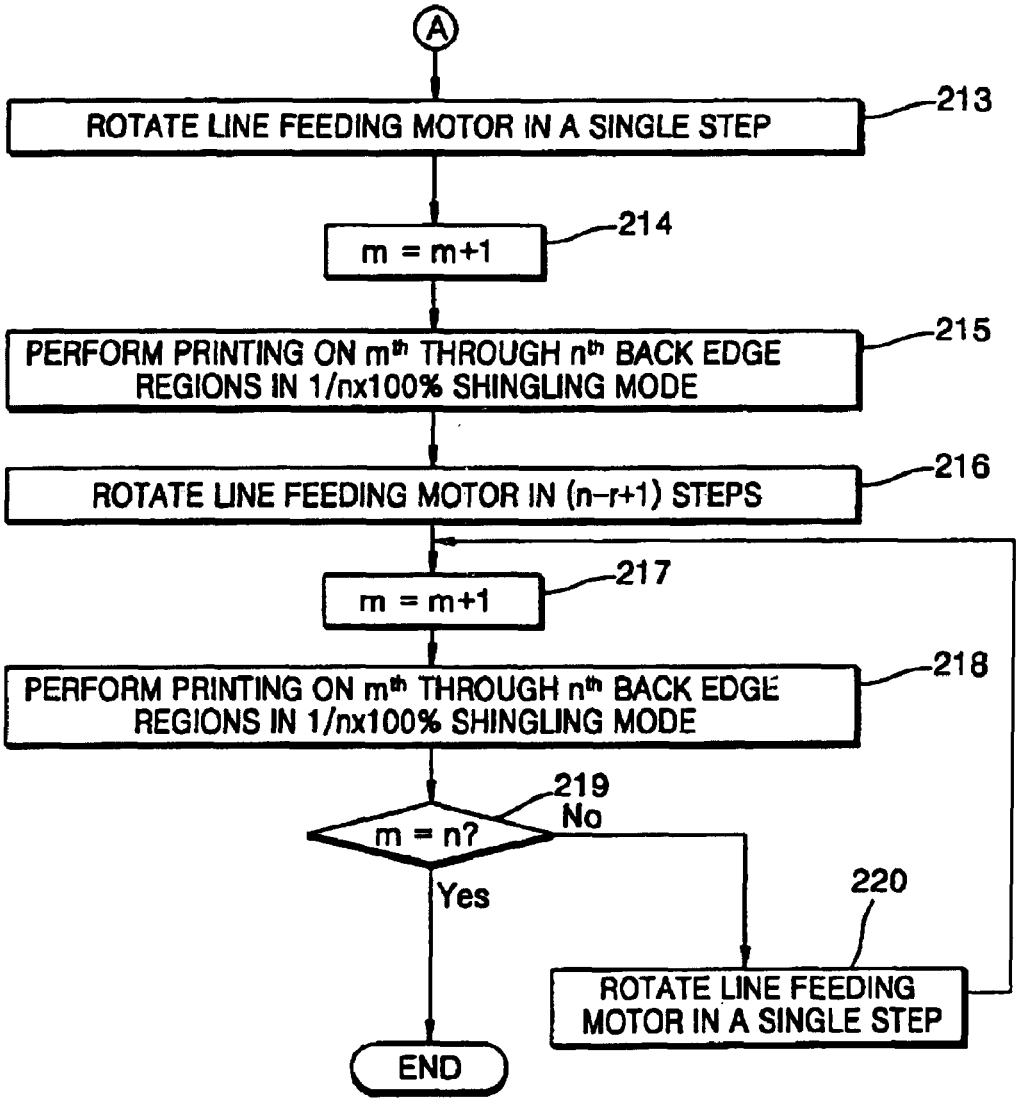
Figure 11C:
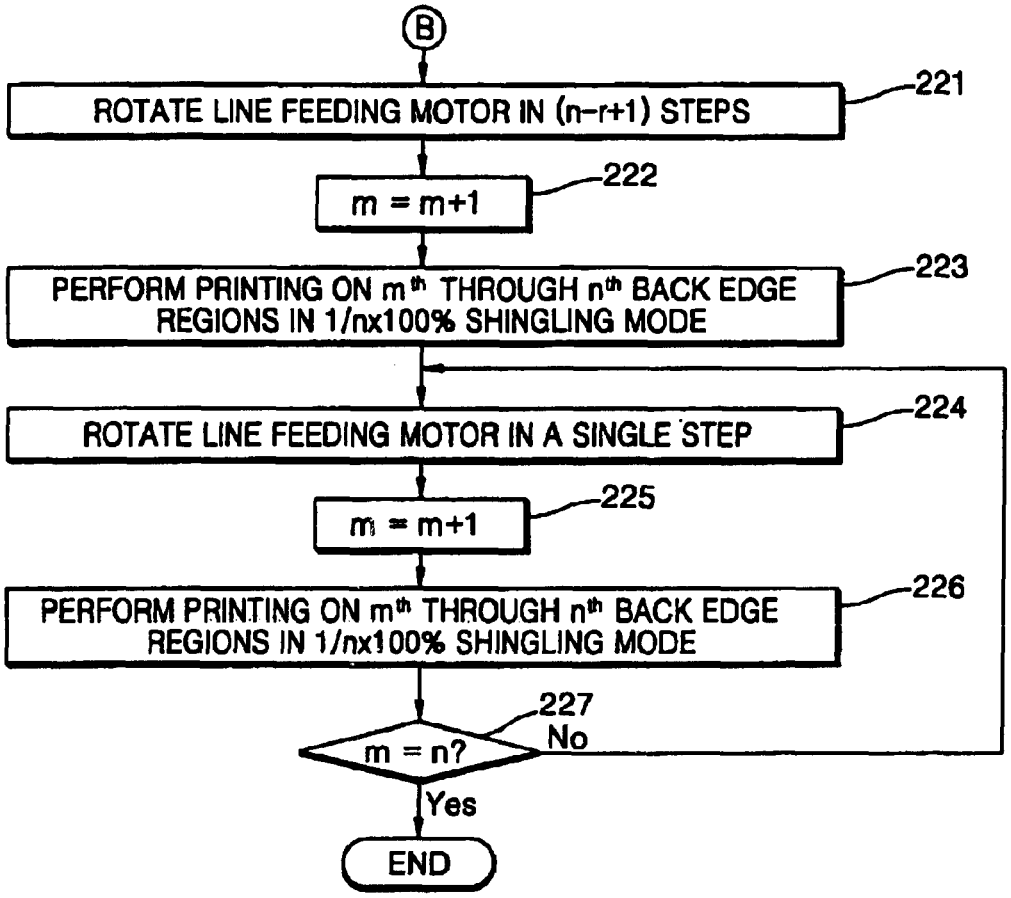

If it is determined in operation 212 of FIG. 11A that r>2, and the path B is selected, referring to FIG. 11C, the line feeding motor is rotated by (n−r+1) steps in operation 221, the parameter m is increased by 1 in operation 222, and the printing is performed on the $m^{th}$ through $n^{th}$ back edge regions in a 1/n×100% shingling mode in operation 223. Next, the line feeding motor is rotated by the single step in operation 224, the parameter m is increased by 1, the printing is performed on the $m^{th}$ through $n^{th}$ back edge regions in the 1/n×100% shingling mode. It is determined whether m=n in operation 227. If m=n, the back edge printing in the shingling mode is terminated. If m<n, the process goes to operation 224 to repeat printing until the parameter m becomes equal to n.

For example, referring to FIG. 13A, with the assumption that r=4 and the path B is selected, after printing with m=5, the line feeding motor is rotated by 5 (=n−s+1) steps, the parameter m is increased by 1 and set to 6, and the printing is performed on the sixth, seventh, and eighth back edge regions ⑥, ⑦, and ⑧ in the ⅛*100% shingling mode. The line feeding motor is rotated by the single step, the parameter m is increased to 7, and the printing is performed on the seventh and eighth back edge regions ⑦ and ⑧ in the ⅛*100% shingling mode. Since m≠n, the line feeding motor is rotated further by the single step, the parameter m is increased to 8, and the printing is performed on the eighth back edge region ⑧ in the ⅛*100% shingling mode. Since m=n, the back edge printing in the shingling mode is terminated.

Figure 11D:
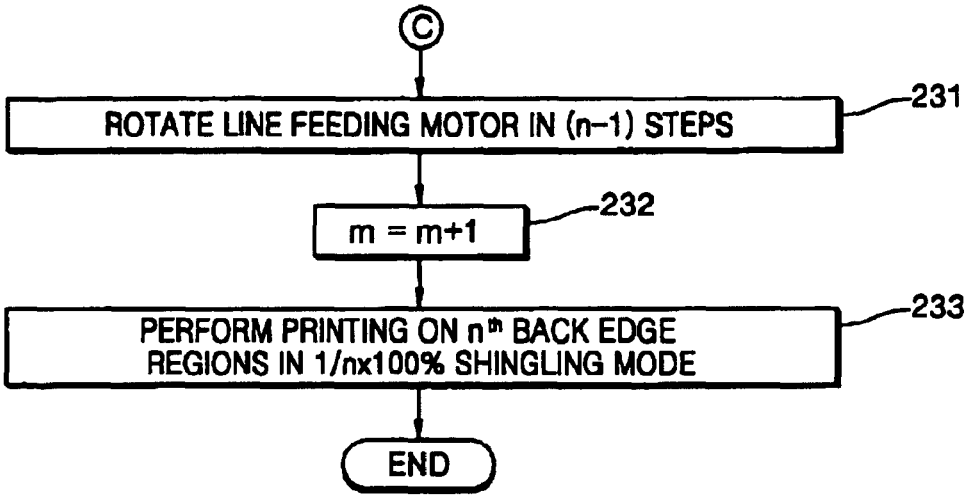

If it is determined in operation 212 of FIG. 11A that r=2, the process goes to path C. Referring to FIG. 11D, the line feeding motor is rotated by (n−1) steps in operation 231, the parameter m is increased by 1 in operation 232, and the printing is performed on the $n^{th}$ back edge region in the 1/n×100% shingling mode in operation 233, thereby terminating the back edge printing in the shingling mode. This printing operation in the path C will be described later in detail with reference to FIG. 13D.

In the shingling method for back edge printing according to the present invention, with the assumption that the 1/n×100% shingling mode is set as a default, the ink head 35 is divided into n nozzle sections, the back edge region of the printing paper 32 to be printed is divided into n back edge regions, wherein the nth back edge region is the last back edge region.

FIGS. 12A through 12E schematically illustrate another shingling algorithm for back edge printing according to another embodiment of the present invention. Referring to FIG. 12A, before the shingling algorithm for back etching printing is applied, while the line feeding motor is rotated to advance the printing paper 32 step by step, and the ink is discharged from the nozzle sections 35-1, 35-2, 35-3, 35-4, 35-5, 35-6, 35-7, and 35-8 to perform printing in the 12.5% shingling mode. On the right of each of the nozzle sections 35-1, 35-2, 35-3, 35-4, 35-5, 35-6, 35-7, and 35-8, the shingling printing percentage of each preceding region of the printing paper 32 is expressed as 1, 11, 111, 1111, 111111, 111111, 11111111, and 11111111, which indicate that shingling printing is performed on the corresponding region at 12.5%, 25%, 37.5%, 50%, 62.5%, 75%, 87.5%, and 100%, respectively.

Figure 12B:
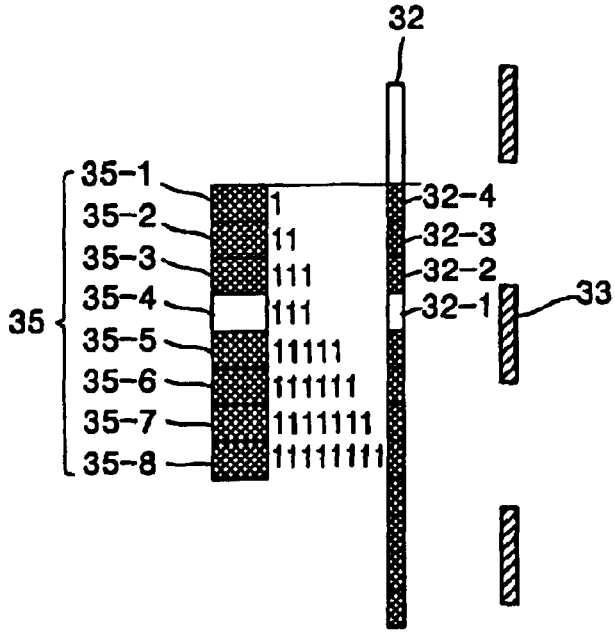

Referring to FIG. 12B, after the line feeding motor is rotated further by the single step to advance a first back edge region 32-1 to the nozzle section 35-4, the ink is discharged from the nozzle sections 35-1, 35-3, 35-5, 35-6, 35-7, and 35-8, except for the nozzle section 35-4, in the 12.5% shingling mode so that the shingling printing percentage of the first back edge region 32-1 that has reached the nozzle section 35-4 remains at 37.5% to be the same as that of the following second back edge region 32-2. "1" on the right of the nozzle section 35-1 indicates that the shingling printing is performed on a fourth back edge region 32-4 at 12.5%, "11" on the right of the nozzle section 35-2 indicates that the shingling printing is performed on a third back edge region 32-3 at 25%, and "111" on the right of the nozzle sections 35-3 and 35-4 indicate that the shingling printing is performed on the second and first back edge regions 32-2 and 32-1 at 37.5%. Also, 11111 on the right of the nozzle section 35-5, 111111 on the right of nozzle section 35-6, 11111111 on the right of nozzle section 35-7, and 11111111 on the right of nozzle section 35-8 indicate that the shingling printing is performed on the corresponding region at 62.5%, 75%, 87.5%, and 100%, respectively.

Figure 12C:
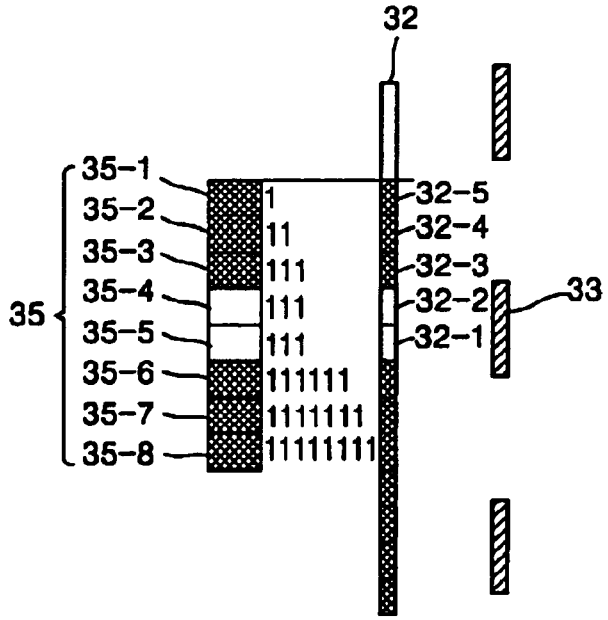

Referring to FIG. 12C, after the line feeding motor is rotated further to advance the printing paper 32 by the single step, the ink is discharged only from the nozzle sections 35-1, 35-2, 35-3, 35-6, 35-7, and 35-8, not from the nozzle sections 35-4 and 35-5, in the 12.5% shingling mode. Accordingly, the shingling printing percentages of the first and second back edge regions 32-1 and 32-2 that have reached the respective nozzle sections 35-5 and 35-4 remain at 37.5%. The shingling printing is performed on the regions of the printing paper 32 that have reached the nozzle sections 35-8, 35-7, and 35-6 at 100% (11111111), 87.5% (1111111), and 75% (1111111), respectively. The shingling printing is performed on third, fourth, and fifth back edge regions 32-3, 32-4, and 32-5 of the printing paper 32 that have reached the nozzle sections 35-3, 35-2, and 35-1 at 37.5% (111), 25% (11), and 12.5% (1), respectively.

Figure 12D:
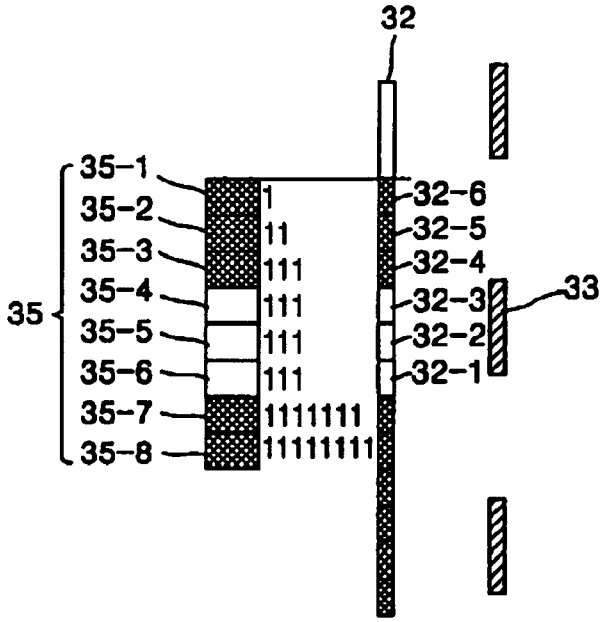

Referring to FIG. 12D, after the line feeding motor is rotated further to advance the printing paper 32 by the single step, the ink is discharged from the nozzle sections 35-1, 35-2, 35-3, 35-7, and 35-8, not from the nozzle sections 35-4, 35-5, and 35-6, in the 12.5% shingling mode. Accordingly, the shingling printing percentages of the first, second, and third back edge regions 32-1, 32-2, and 32-3 of the printing paper 32 that have reached the respective nozzle sections 35-6, 35-5, and 35-4 remain at 37.5% (111). The shingling printing is performed on the fourth, fifth, and sixth back edge regions 32-4, 32-5, and 32-6 of the printing paper 32 that have reached the nozzle sections 35-3, 35-2, and 35-1 at 37.5% (111), 25% (11), and 12.5% (1), respectively. The shingling printing is performed on the regions of the printing paper 32 that have reached the nozzle sections 35-8 and 35-7 at 100% (11111111) and 87.5% (1111111), respectively.

Figure 12E:
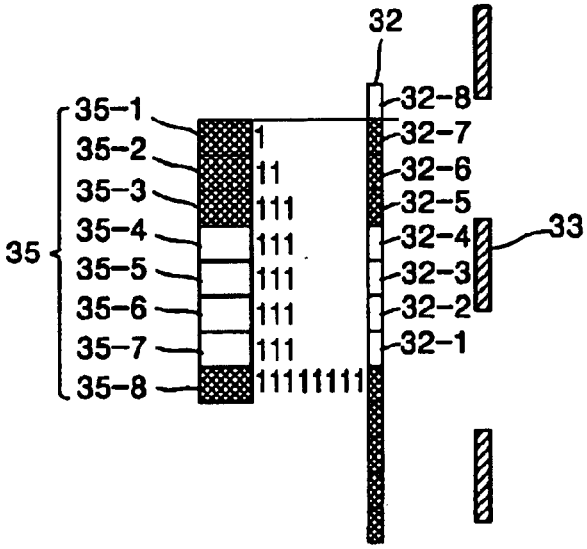

Referring to FIG. 12E, after the line feeding motor is rotated further to advance the printing paper 32 by the single step, the ink is discharged from the nozzle sections 35-1, 35-2, 35-3, and 35-8, not from the nozzle sections 35-4, 35-5, 35-6, and 35-7, in the 12.5% shingling mode. Accordingly, the shingling printing percentages of the first, second, third, and fourth back edge regions 32-1, 32-2, 32-3, and 32-4 of the printing paper 32 that have reached the respective nozzle sections 35-7, 35-6, 35-5, and 35-4 remain at 37.5% (111). The shingling printing is performed on the fifth, sixth, and seventh back edge regions 32-5, 32-6, and 32-7 of the printing paper 32 that have reached the nozzle sections 35-3, 35-2, and 35-1 at 37.5% (111), 25% (11), and 12.5% (1), respectively. The shingling printing is performed on a region of the printing paper 32 that has reached the nozzle section 35-8 at 100% (11111111). At this time, the last back edge region 32-8 of the printing paper 32 is the single step behind the nozzle section 35-1.

Figure 12F:
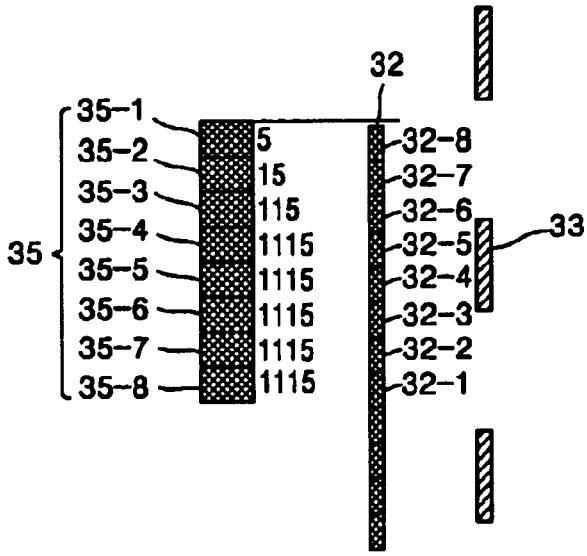

Referring to FIG. 12F, as the line feeding motor is rotated further to draw the region of the printing paper 32 that has reached the nozzle section 35-8 out and away from the ink head 35 toward the paper exit roller 36 and to advance the last back edge region 32-8 to the nozzle section 35-1, the ink is discharged from all of the nozzle sections 35-1, 35-2, 35-3, 35-4, 35-6, 35-7, and 35-8 for printing in a 62.5% (=⅝*100%) shingling mode. As a result, the shingling printing is performed on the sixth, seventh, and eighth back edge regions 32-6, 32-7, and 32-8 that have reached nozzle sections 35-3, 35-2, and 35-1 at 87.5% (115), 75% (15), and 62.5% (5), respectively. The shingling printing is performed on the first, second, third, fourth, and fifth back edge regions 32-1, 32-2, 32-3, 32-4, and 32-5 that have reached the respective nozzle sections 35-4, 35-5, 35-6, 35-7, and 35-8 at 100%.

Figure 12G:
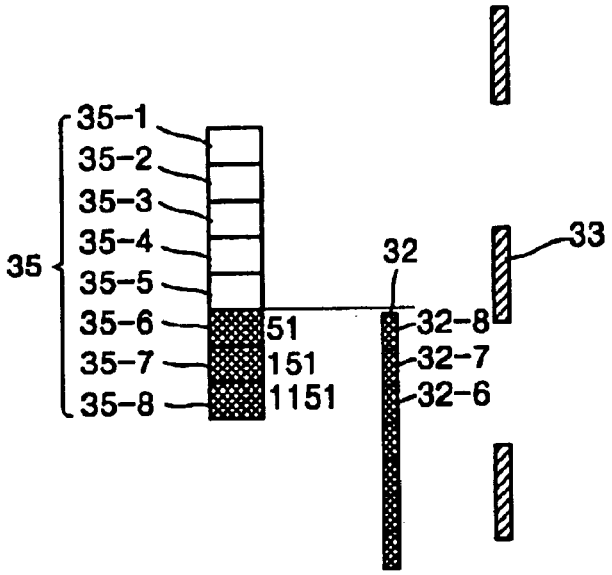

Referring to FIG. 12G, since the first through fifth back edge regions 32-1 through 32-5 on which the 100% shingling printing has been undergone through the previous printing in the 62.5% shingling mode, the line feeding motor is rotated in 5 steps to draw the first through fifth back edge regions 32-1 through 32-5 out and away from the ink head 35. The printing is performed only on the sixth, seventh, and eighth back edge regions 32-6, 32-7, and 32-8 that have reached the respective nozzle sections 32-8, 32-7, and 32-6 in the 12.5% shingling mode. As a result, the shingling printing is performed on the sixth back edge region 32-6 at 100% (1151), the seventh back edge region 32-7 at 87.5% (151), and the eighth back edge region 32-8 at 75% (51).

Figure 12H:
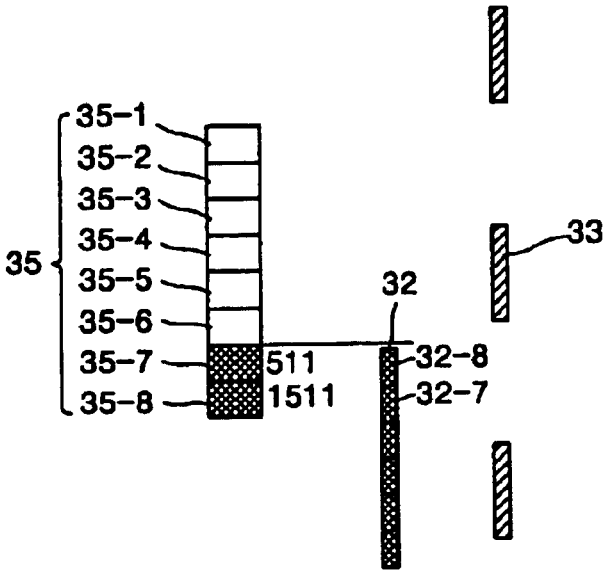

Referring to FIG. 12H, the line feeding motor is rotated by the single step to advance the seventh back edge region 32-7 of the printing paper 32 to line up beneath the nozzle section 35-8, the ink is discharged only from the nozzle sections 35-7 and 35-8 to perform printing on the eighth and seventh back edge regions 32-8 and 32-7 in the 12.5% shingling mode. As a result, the shingling printing is performed on the seventh back edge region 32-7 at 100% (1511) and the eighth back edge region 32-8 at 87.5% (511).

Figure 12I:
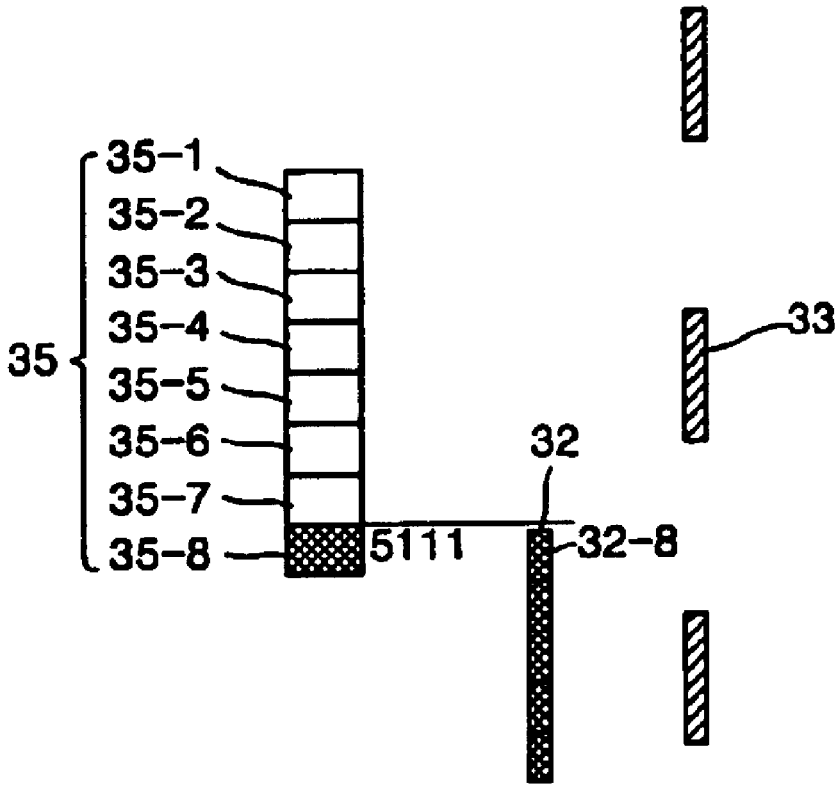

Referring to FIG. 12I, the line feeding motor is rotated further by the single step to advance the last eighth back edge region 32-8 of the printing paper 32 to the nozzle section 35-8, and the printing is performed thereon in the 12.5% shingling mode. As a result, the back edge printing in the shingling mode is terminated.

The above method of back edge printing according to the present invention described with reference to FIGS. 12A through 12I is tabulated in FIG. 13A. In this method, the shingling printing is performed according to the path B of FIG. 11C.

With the assumption that the shingling algorithm is designed to rotate the line feeding motor in 5 steps in order to perform the printing on an entire back edge region at least once, referring to FIG. 13A, after printing with m=1, it is determined whether the first back edge region ① has reached the nozzle section 35-4 that is located 5 steps behind the nozzle section 35-8 of the ink head 35, as in operation 205 of FIG. 11A. When the first back edge region ① reaches the nozzle section 35-4, the ink is discharged from the nozzles sections 35-1, 35-2, 35-3, 35-6, 35-7, and 35-8, but not the nozzle section 35-4, to perform the printing on the regions of the printing paper 32 beneath the nozzle sections from which the ink is discharged, except for the first back edge region ①, in the 12.5% (=⅛*100%) shingling mode, as in operation 207 of FIG. 11A.

In this embodiment, a region of the printing paper 32 located beneath the nozzle section 35-4 is counted as the first back edge region ①, the following region beneath the nozzle section 35-3 as the second back edge region ②, the following region beneath the nozzle section 35-2 as the third back edge region ③, and the following region beneath the nozzle section 35-1 as the fourth back edge region ④. As a result of printing with m=1, a total of 37.5% (=⅜*100%) shingling printing is performed on the first and second back edge regions ① and ②, a total of 25% (=⅜*100) shingling printing is performed on the third back edge region ③, and a total of 12.5% (=⅛*100) shingling printing is performed on the fourth back edge region ④.

Next, the first back edge region ① of the printing paper 32 is advanced by the single step to be directly beneath the nozzle section 35-5, and the parameter m is set to 2. At this time, since m≠n−r+1(=5), the printing is performed on the regions of the printing paper 32 excluding the first and second back edge regions ① and ② in the 12.5% (=⅛*100%) shingling mode, as in operation 207 of FIG. 11A. As a result of printing with m=2, the shingling printing is performed on a region located beneath the nozzle section 35-8 at 100% (=⅝*100%), a region located beneath the nozzle section 35-7 at 87.5% (=⅞*100%), and a region located beneath the nozzle section 35-6 at 75% (=⅝*100%). The shingling printing percentage of each of the first and second back edge regions ① and ② located beneath respective nozzle sections 35-5 and 35-4 remains at 37.5% (=⅜*100%) that has been achieved at the previous stage. Also, the shingling printing is performed on the third back edge region ③ located beneath the nozzle section 35-3 at 37.5% (=⅜*100%), the fourth back edge region ④ located beneath the nozzle section 35-2 at 25% (=⅜*100%), and the fifth back edge region ⑤ located beneath the nozzle section 35-1 at 12.5% (=⅛*100%).

The line feeding motor is rotated further by the single step to advance the first back edge region ① to line up beneath the nozzle section 35-6, and the parameter m is increased to 3. At this time, since m≠n−r+1(=5), the printing is performed on the regions of the printing paper 32 excluding the first, second, and third back edge regions ①, ②, and ③ in the 12.5% (=⅛*100%) shingling mode, as in operation 207 of FIG. 11A. As a result of printing with m=3, the shingling printing is performed on a region located beneath the nozzle section 35-7 at 87.5% (=⅞*100%) and a region located beneath the nozzle section 35-8 at 87.5% (=⅝*100%). Since no ink is discharged from the nozzle sections 35-4, 35-5, and 35-6, the shingling printing percentage of each of the first, second, and third back edge regions ①, ②, and ③ beneath the respective nozzle sections 35-6, 35-5, and 35-4 remains at 37.5% (=⅜*100%) that has been achieved at the previous stage. Also, the shingling printing is performed on the fourth back edge region ④ beneath the nozzle section 35-3 at 37.5% (=⅜*100%), the fifth back edge region ⑤ beneath the nozzle section 35-2 at 25% (=⅜*100%), and the sixth back edge region ⑥ beneath the nozzle section 35-1 at 12.5% (=⅛*100%).

When m=4 (≠n−r+1(=5)), no ink is discharged from the nozzle sections 35-7,35-6, 35-5, and 35-4, so that the shingling printing percentage of each of the first, second, third, and fourth back edge regions ①, ②, ③, and ④ remains at 37.5% (=⅜*100%) that has been achieved at the previous stage. As a result of printing in the 12.5% (=⅛*100%) shingling mode, a total of 37.5% (=⅜*100%) shingling printing is performed on the fifth back edge region ⑤ beneath the nozzle section 35-3, a total of 25% (=⅜*100%) shingling printing is performed on the sixth back edge region ⑥ beneath the nozzle section 35-2, and a total of 12.5% (=⅛*100%) is performed on the seventh back edge region ⑦ beneath the nozzle section 35-1.

After the line feeding motor is rotated further by the single step, and the parameter m is increased to 5, the ink is discharged from the nozzle sections 35-1, 35-2, 35-3, 35-4, 35-5, 35-6, 35-7, and 35-8 in a 62.5% (=⅝*100%) shingling mode, as in operation 211 of FIG. 11A. As a result, the shingling printing is performed on each of the first through fifth back edge regions ①, ②, ③, ④, and ⑤ and at 100% (=⅝*100%), the sixth back edge region ⑥ at 82.5% (=⅞*100%), the seventh back edge region ⑦ at 75% (=⅝*100%), and the eighth back edge region ⑧ at 62.5% (=⅝*100%).

For printing with m=6, the line feeding motor is rotated by 5 steps, as in operation 221 of FIG. 11C, to draw the first through fifth back edge regions ① through ⑤ on which the 100% shingling printing has been undergone, out and away from the ink head 35. The ink is discharged from the nozzle sections 35-6, 35-7, and 35-8 for printing in the 12.5% (=⅛*100%) shingling mode, as in operation 223 of FIG.

11C. As a result, the shingling printing is performed on the sixth back edge region ⑥ at 100% (=8/8*100%), the seventh back edge region ⑦ at 82.5% (=7/8*100%), and the eighth back edge region ⑧ at 75% (=6/8*100%).

The line feeding motor is rotated further by the single step, as in operation 224 of FIG. 11C, the parameter m is increased to 7, and the printing is performed in the 12.5% (=1/8*100%) shingling mode, as in operation 226 of FIG. 11C. As a result, the shingling printing is performed on the seventh back edge region ⑥ at 100% (=8/8*100%) and the eighth back edge region ⑦ at 87.5% (=7/8*100%). Next, the line feeding motor is rotated further by the single step to advance the eighth back edge region ⑧ to be directly beneath the nozzle section 35-8, and the printing is performed on the eighth back edge region ⑧ in the 12.5% (=1/8*100%) shingling mode. As a result, the shingling printing is performed on the eighth back edge region 100%, thereby terminating the back edge printing through 8 printing operations after operation 227 of FIG. 11C.

FIG. 13B is a table illustrating another shingling method for back edge printing according to another embodiment of the present invention. In this method, the shingling printing is performed according to the path A of FIGS. 11A and 11B.

In this shingling method for back edge printing, the printing is performed in a similar manner as the method shown in FIG. 13A up to the fifth printing operation (m=5), but the line feeding motor is rotated only by the single step, instead of 5 steps, for a next printing operation with m=6 (refer to operation 213 of FIG. 11B). As a result, the first back edge region ① is drawn out and away from the ink head 35. In printing with m=6, the printing is performed only on the sixth, seventh, and eighth back edge regions ⑥, ⑦, and ⑧ in the 12.5% (=1/8*100%) shingling mode, so that the shingling printing is performed on the sixth back edge region ⑥ at 100%. Accordingly, five back edge regions on which the 100% shingling printing has been undergone, including the sixth back edge region ⑥ and the second through fifth back edge regions ② through ⑤ on which the 100% shingling printing has been undergone at the previous stage, are beneath the ink head 35. Next, for printing with m=7, the line feeding motor is rotated by the 5 steps, as in operation 216 of FIG. 11B, to draw the second through sixth back edge portions ② through ⑥ out and away from the ink head 35. The printing is performed on the seventh and eighth back edge portions ⑦ and ⑧ in the 12.5% shingling mode, as in operation 226 of FIG. 11C. As a result, the shingling printing is performed on the seventh and eighth back edge portions ⑦ and ⑧ at 100% and 87.5%, respectively. In printing with m=8, the shingling printing is performed on the eighth back edge portion ⑧ at 100%, thereby terminating the back edge printing in a shingling mode.

FIG. 13C is a table illustrating another shingling method for back edge printing according to another embodiment of the present invention where the 12.5% shingling mode is set as a default. In this method, the shingling printing is performed according to the path B of FIGS. 11A and 11C.

When the first back edge region ① of the printing paper reaches the nozzle section 35-3 that is designated as nozzle section r, the parameter m is set to 1, and the printing is performed on regions of the printing paper 32 excluding the first back edge region ① in the 12.5% shingling mode. Since the nozzle section 35-3 is 6 (=n−r+1) steps behind the nozzle section 35-8, the shingling printing is performed in a 75% (=6/8*100%) shingling mode when m=6, and the printing paper 32 is advanced 6 steps for printing with m=7. As a result of printing with m=1, the shingling printing percentage of the first back edge region remains at 25% (=2/8*100%), and the shingling printing is performed on the second back edge region ② at 25% (=2/8*100%) and the third back edge region ③ at 12.5% (=1.8*100%).

The line feeding motor is rotated by the single step for printing with m=2. The first back edge region lines up beneath the nozzle section 35-4, and the ink is discharged from the nozzle sections 35-1, 35-2, 35-5, 35-6, 35-7, and 35-8, except the nozzle sections 35-3 and 35-4, for printing in the 12.5% shingling mode. The shingling printing percentage of each of the first and second back edge regions ① and ② remains 25% (=2/8*100%) that has been achieved at the previous printing operation. As a result of printing in the 12.5% shingling mode, the shingling printing is performed on the third back edge region ③ at 25% (=2/8*100%) and the fourth back edge region ④ at 12.5%.

Next, the line feeding motor is rotated by the single step, the parameter m is increased to 3, and the ink is discharged only from the nozzle sections 35-1, 35-2, 35-6, 35-7, and 35-8, excluding the nozzle sections 35-3, 35-4, and 35-5, for printing in the 12.5% (=1.8*100%) shingling mode. The shingling printing percentage of each of the first, second, and third back edge regions ①, ②, and ③ remains 25% (=2/8*100%). As a result of printing in the 12.5% shingling mode, the shingling printing is performed on the fourth back edge region ④ at 25% (=2/8*100%) and the fifth back edge region ⑤ at 12.5% (=1/8*100%).

Next, the line feeding motor is rotated by the single step, the parameter m is increased to 4, and the printing is performed on regions of the printing paper 32 except for the first through fourth back edge regions ① through ④ in the 12.5% (=1/8*100%) shingling mode. As a result, the shingling printing percentage of each of the first through fourth back edge regions ① through ④ remains 25% (=2/8*100%), and the shingling printing is performed on the fifth back edge region ⑤ at 25% (2/8*100%) and the sixth back edge region ⑥ at 12.5% (=1/8*100%).

Next, the line feeding motor is rotated by the single step for printing with m=5 so that the first back edge region ① lines up beneath the nozzle section 35-7, the printing is performed in the 12.5% shingling mode while no ink is discharged from the nozzle sections 35-7, 35-6, 35-5, 35-4, and 35-3. As a result, the shingling printing percentage of each of the first through fifth back edge regions ① through ⑤ beneath the nozzle sections through which no ink has not been discharged, remains 25% (=2/8*100%). The shingling printing is performed on the sixth back edge region ⑥ beneath the nozzle section 35-2 at 25% (=2/8*100%) and the seventh back edge region ⑦ beneath the nozzle section 35-1 at 12.5% (=1/8*100%).

Next, for printing with m=6, the line feeding motor is rotated by the single step to advance the first back edge region ① to line up beneath the nozzle section 35-8. The ink is discharged from all of the nozzle sections 35-1 through 35-8 for printing in a 75% (=6/8*100%) shingling mode. As a result, the shingling printing is performed on the first through sixth back edge regions ① through ⑥ at 100%, the seventh back edge region ⑦ at 87.5% (=7/8*100%), and the eighth back edge region ⑧ at 75% (=6/8*100%).

Next, for printing with m=7, the line feeding motor is rotated in 6 steps so that the first through sixth back edge regions ① through ⑥ are drawn out and away from the ink head 35. The printing is performed on the seventh and eighth back edge regions ⑦ and ⑧ in the 12.5% (=1/8*100%) shingling mode. As a result, the shingling printing is performed on the seventh back edge region ⑦ at 100% and the eighth back edge region ⑧ at 87.5% (=7/8*100%).

Next, for printing with m=8, the line feeding motor is rotated further by the single step to advance the eighth back edge region ⑧ to line up beneath the nozzle section 35-8. The printing is performed on the eight back edge region ⑧ in the 12.5% shingling mode, thereby terminating the back edge printing in the shingling mode.

FIG. 13D is a table illustrating another shingling method for back edge printing according to another embodiment of the present invention where the 12.5% shingling mode is set as a default, and the back edge printing is terminated through seven printing operations. In this method, the shingling printing is performed according to the path C of FIGS. 11A and 11D.

When the first back edge region ① of the printing paper 32 reaches the nozzle section 35-2 that is designated as nozzle section r, as in operation 205 of FIG. 11A, the parameter m is set to 1, and the printing is performed on regions of the printing paper 32 excluding the first back edge region ① in the 12.5% shingling mode, as in operation 207 of FIG. 11A. The line feeding motor is rotated step by step, and the printing is repeatedly performed in the 12.5% (=⅛*100%) shingling mode until the parameter m becomes 6, in such a manner that no ink is discharged onto the first through $m^{th}$ back edge regions, as in operation 207 through 210 of FIG. 11A. As a result of printing with m=6, the shingling printing is performed on each of the first through seventh back edge regions ① through ⑦ at 12.5% (=⅛*100%), and the first back edge region ① is directly beneath nozzle section 35-7.

For printing with m=7, the line feeding motor is rotated further by the single step, and the ink is discharged from all of the nozzle sections 35-1 through 35-7 for printing in a 87.5% (=⅞*100%) shingling mode, as in operation 211 of FIG. 11A, so that the shingling printing is performed on each of the first through seventh back edge regions ① through ⑦ at 100% and the eighth back edge region ⑧ at 87.5% (=⅞*100%). For printing with m=8, the line feeding motor is rotated by 7 steps, as in operation 231 of FIG. 11D, to draw the first through seventh back edge regions ① through ⑦ out and away from the ink head 35. Next, the printing is performed on the eighth back edge region ⑧ in the 12.5% shingling mode, as in operation 213 of FIG. 11C. As a result, the back edge printing in the shingling mode is terminated.

FIG. 14A is a table illustrating another shingling method for back edge printing according to another embodiment of the present invention where the 20% shingling mode is set as a default. In this method, the shingling printing is performed according to the path B of FIGS. 11A and 11C.

When the first back edge region ① of the printing paper 32 reaches the nozzle section 45-3 that is designated as a nozzle section r, the parameter m is set to 1, and the ink is discharged from the nozzle sections 45-1, 45-2, 45-4, and 45-5, but not the nozzle section 45-3, for printing in the 20% shingling mode. As a result, the shingling printing is performed on each of the first and second back edge regions ① and ② at 40% (=⅖*100%) and the third back edge region ③ at 20% (=⅕*100%).

For printing with m=2, the line feeding motor is rotated by the single step so that a fourth back edge region ④ just reaches the ink head 35 to line up beneath the nozzle section 45-1. Next, the printing is performed on the third and fourth back edge regions ③ and ④, not on the first and second back edge regions ① and ②, in the 20% shingling mode.

For printing with m=3, the line feeding motor is rotated by the single step, and the ink is discharged from all of the nozzle sections 45-1 through 45-5 for printing in a 60% (=⅗*100%) shingling mode. As a result, the shingling printing is performed on each of the first, second, and third back edge regions ①, ②, and ③ at 100%, the fourth back edge region ④ at 80% (=⅘*100%), and the fifth back edge region ⑤ at 60% (=⅗*100%).

Next, for printing with m=4, the line feeding motor is rotated by 3 steps to draw the first, second, and third back edge regions ①, ②, and ③ out and away from the ink head 35. The printing is performed on the fourth and fifth back edge regions ④ and ⑤ in the 20% shingling mode. As a result, the shingling printing is performed on the fourth back edge region ④ beneath the nozzle section 45-5 at 100% and the fifth back edge region ⑤ beneath the nozzle section 45-4 at 80% (=⅘*100%). Next, for printing with m=5, the line feeding motor is rotated further by the single step to advance the fifth back edge region ⑤ to line up beneath the nozzle section 45-5, the printing is performed on the fifth back edge region ⑤ in the 20% (=⅕*100%) shingling mode, thereby terminating the back edge printing in the shingling mode.

Alternatively, for printing with m=4, the line feeding motor may be rotated only by the single step. In this case, only the first back edge region ① is drawn out and away from the ink head 35, and the printing is performed only on the fourth and fifth back edge regions ④ and ⑤ in the 20% shingling mode, so that the shingling printing is achieved at 100% for each of the second, third, and fourth back edge regions ②, ③, and ④. Next, for printing with m=5, the line feeding motor is rotated by the 3 steps such that the second, third, and fourth back edge regions ②, ③, and ④ are drawn out and away from the ink head 35, and the fifth back edge region ⑤ is directly beneath the nozzle section 45-5. Through an additional printing operation on the fifth back edge region ⑤ in the 20% shingling mode, the back edge printing is terminated.

FIG. 14B is a table illustrating another shingling method for back edge printing according to another embodiment of the present invention where the 20% shingling mode is set as a default. Unlike the method shown in FIG. 14A, the line feeding motor is rotated by up to 4 steps in this method, and the shingling printing is performed according to the path C of FIGS. 11A and 11D.

When the first back edge region ① of the printing paper 32 reaches the nozzle section 45-2 that is designated as the nozzle section r, the parameter m is set to 1, and the ink is discharged from the nozzle sections 45-1, 45-3, 45-4, and 45-5, but not the nozzle section 45-2, for printing in the 20% (=⅕*100%) shingling mode. When m=2, no ink is discharged from the nozzle sections 45-2 and 45-3, so that the printing is performed on regions of the printing paper 32 excluding the first and second back edge regions ① and ② beneath the respective nozzle sections 45-3 and 45-2. When m=3, no ink is discharged from the nozzle sections 45-2, 45-3, and 45-4, so that the printing is performed on regions of the printing paper 32 excluding the first, second, and third back edge regions ①, ②, and ③ beneath the respective nozzle sections 45-4, 45-3, and 45-2.

For printing with m=4, the line feeding motor is rotated by the single step, and the ink is discharged from all of the nozzle sections 45-1 through 45-5 for printing in a 80% (=⅘*100%) shingling mode. As a result, the shingling printing is performed on each of the first, second, third, and fourth back edge regions ①, ②, ③, and ④ at 100% and the fifth back edge region ⑤ at 80% (=⅘*100%). For printing with m=5, the line feeding motor is rotated by 4 steps so that the first through fourth back edge regions ① through ④ are drawn out and away from the ink head 35. The printing is performed on the fifth back edge region ⑤ in the 20% (=⅕*100%) shingling mode, thereby terminating the back edge printing in the shingling mode.

FIG. 15 is a table illustrating another shingling method for back edge printing according to another embodiment of the present invention where the 25% shingling mode is set as a default.

When the first back edge region ① of the printing paper 32 reaches the nozzle section 55-2 that is designated as nozzle section r, the parameter m is set to 1, and the ink is discharged from the nozzle sections 55-1, 55-3, and 55-4, but not the nozzle section 55-2, for printing in the 25% (=¼*100%) shingling mode.

When m=2, no ink is discharged from the nozzle sections 55-2 and 55-3, so that the printing is performed on regions of the printing paper 32 excluding the first and second back edge regions ① and ② beneath the respective nozzle sections 55-3 and 55-2. As a result, the shingling printing percentage of each of the first and second back edge regions ① and ② remains at 25% (=¼*100%), and the shingling printing is performed on the third back edge region ③ at 25%.

When m=3, the ink is discharged from all of the nozzle sections 55-1 through 55-4 for printing in a 75% (=¾*100%) shingling mode. As a result, the shingling printing is performed on each of the first, second, and third back edge regions ①, ②, and ③ at 100% and the fourth back edge region ④ at 75% (=¾*100%).

For printing with m=4, the line feeding motor is rotated by 3 steps so that the first, second, and third back edge regions ①, ②, and ③ are drawn out and away from the ink head 35. The printing is performed on the fourth back edge region ④ in a 25% (=¼*100%) shingling mode, thereby terminating the back edge printing in the shingling mode.

According to the present invention, high quality front or back edge printing can be achieved using the shingling algorithm without ink contamination of the printing paper and the ribs.

While the present invention has been particularly described in the above with reference to embodiments thereof, the above embodiments of the present invention are for illustrative purposes and are not intended to limit the scope of the present invention. For example, it will be understood by those skilled in the art that any algorithms of various shingling modes can be applied without departing from the spirit and scope of the invention as defined by the appended claims and their equivalents.

What is claimed is:

1. A shingling method for front edge printing in a printing apparatus having an ink head and a line feeding motor feeding a sheet of printing paper in a paper advance direction, the method comprising:

(a) setting a 1/n×100% shingling mode as a default of the printing apparatus to divide a nozzle portion of the ink head into nozzle sections 1 through n in the paper advance direction and a front edge region of the prining paper into first through $n^{th}$ front edge regions each having the same width as each nozzle section of the ink head in the paper advance direction;

(b) rotating the line feeding motor by a single step corresponding to the width so that the first front edge region of the printing paper lines up beneath the nozzle section 1 of the ink head, to set a parameter m, which is an integer indicating the number of printing operations, to 1, and to perform printing on the first front edge region of the printing paper in the 1/n×100% shingling mode;

(c) when the first front edge region of the printing paper lines up beneath the nozzle section 2 of the ink head, increasing the parameter m to 2 to perform printing on the first and second front edge regions of the printing paper in the 1/n×100% shingling mode;

(d) when the first front edge region of the printing paper lines up beneath the nozzle section (s+2), where 1<s<n, increasing the parameter m to 3 to perform printing on the first through $(s+2)^{th}$ front edge regions of the printing paper in a s/n×100% shingling mode;

(e) increasing the parameter m by 1 to perform printing on regions of the printing paper excluding $m^{th}$ trough $(s+2)^{th}$ front edge regions in the 1/n×100% shingling mode; and (f) repeating operation (e) until m=s+2, rotating the line feeding motor by the single step if m=s+2, and performing printing on regions of the printing paper beneath the nozzle sections n through 1 of the ink head in the 1/n×100% shingling mode.

2. The shingling method of claim 1, wherein the printing paper has one of different sizes.

3. The shingling method of claim 1, wherein the printing apparatus comprises paper feed and exit rollers disposed in the paper advance direction and a plurality of ribs disposed at intervals between the paper feed roller and the paper exit roller in a direction perpendicular to the paper advance direction.

4. The shingling method of claim 1, wherein the rotating of the line feeding motor by the single step corresponding to the width comprises:

discharging ink from the nozzle section 1 of the ink head.

5. The shingling method of claim 1, wherein the increasing of the parameter m to 2 comprises:

rotating the line feeding motor by the single step; and discharging ink from the nozzle sections 2 and 1 of the ink head positioned above the first and second front edge regions of the printing paper.

6. The shingling method of claim 1, wherein the increasing of the parameter m to 3 comprises:

rotating the line feeding motor by s steps; and discharging ink from the nozzle sections (s+2) through 1 of the ink head positioned above the first through $(s+2)^{th}$ front edge regions of the printing paper.

7. The shingling method of claim 1, wherein the increasing of the parameter m by 1 comprises:

rotating the line feeding motor by the single step; and discharging ink from the nozzle sections excluding the nozzle sections s through $(m-2)^{th}$ of the ink head positioned above $m^{th}$ through $(s+2)^{th}$ front edge regions of the printing paper.

8. The shingling method of claim 1, the repeating of the operation (e) until m=s+2, comprises: rotating the line feeding motor by the single step to increase the parameter m by 1 and perform printing on regions of the printing paper beneath the nozzle sections 1 through n of the ink head in the 1/n×100% shingling mode.

9. The shingling method of claim 8, wherein n is an integer greater than 4.

10. The shingling method of claim 1, wherein n is an integer greater than 4.

11. A shingling method for front edge printing in a printing apparatus having an ink head and a line feeding motor feeding a sheet of printing paper in a paper advance direction, the method comprising:

(a) setting a 1/n×100% shingling mode as a default of the printing apparatus to divide a nozzle portion of the ink head into nozzle sections 1 through n in the paper advance direction and a front edge region of the printing paper into first through $n^{th}$ front edge regions having the same width as each nozzle section of the ink head in the paper advance direction;

(b) rotating the line feeding motor by a single step corresponding to the width so that the first front edge region of the printing paper lines up beneath the nozzle section 1 of the ink head, to set a parameter m, which is an integer indicating the number of printing operations, to 1, and to perform printing on the first front edge region of the printing paper in the 1/n×100% shingling mode;

(c) when the first front edge region of the printing paper lines up beneath the nozzle section (s+1), where 1<s<n, of the ink head, increasing the parameter m to 2 to perform printing on the first through $(s+1)^{th}$ front edge regions of the printing paper in a s/n×100% shingling mode;

(d) increasing the parameter m by 1 to perform printing on regions of the printing paper excluding $m^{th}$ trough $(s+1)^{th}$ front edge regions in the 1/n×100% shingling mode; and (e) repeating operation (d) until m=s+1, rotating the line feeding motor by the single step if m=s+1, to increase the parameter m by 1 and perform printing on regions of the printing paper beneath the nozzle sections n through 1 of the ink head in the 1/n×100% shingling mode.

12. The shingling method of claim 11, wherein the printing paper has one of different sizes.

13. The shingling method of claim 11, wherein the printing apparatus comprises paper feed and paper exit rollers disposed in the paper advance direction and a plurality of ribs disposed at intervals between the paper feed roller and the paper exit roller in a direction perpendicular to the paper advance direction.

14. The shingling method of claim 11, wherein the rotating of the line feeding motor by the single step corresponding to the width comprises:

discharging ink from the nozzle section 1 of the ink head.

15. The shingling method of claim 11, wherein the increasing of the parameter m to 2 comprises:

rotating the line feeding motor by s steps; and discharging ink from the nozzle sections (s+1) through 1 of the ink head positioned above the first through $(s+2)^{th}$ front edge regions of the printing paper.

16. The shingling method of claim 11, wherein the increasing of the parameter m by 1 comprises:

rotating the line feeding motor by the single step; and discharging ink from the nozzle sections excluding the nozzle sections s through 2 of the ink head positioned above the $m^{th}$ through $(s+1)^{th}$ front edge regions of the printing paper.

17. The shingling method of claim 11, wherein the repeating of the operation (d) until m=s+1, comprises:

rotating the line feeding motor by the single step to perform printing on regions of the printing paper positioned beneath the nozzle sections n through 1 of the ink head in the 1/n×100% shingling mode.

18. The shingling method of claim 17, wherein n is an integer greater than 3.

19. The shingling method of claim 11, wherein n is an integer greater than 3.

20. A shingling method for back edge printing in a printing apparatus having an ink head and a line feeding motor feeding a sheet of printing paper in a paper advance direction, the method comprising:

(a) setting a 1/n×100% shingling mode as a default of the printing apparatus to divide a nozzle portion of the ink head into nozzle sections 1 through n in the paper advance direction and a back edge region of the printing paper into first through $n^{th}$ back edge regions having the same width as each nozzle section of the ink head in the paper advance direction;

(b) rotating the line feeding motor so that the first back edge region of the printing paper lines up beneath a nozzle section r, where 2<r<n−1, of the ink head, to set a parameter m, which is an integer indicating the number of printing operations, to 1, and to perform printing on regions of the printing paper excluding the first back edge region in the 1/n×100% shingling mode;

(c) rotating the line feeding motor by a single step corresponding to the width, to increase the parameter m by 1 and perform printing on regions of the printing paper excluding the first through $m^{th}$ back edge regions in the 1/n×100% shingling mode;

(d) repeating operation (c) until m=n−r, to perform printing on the first through $n^{th}$ back edge regions of the printing paper in a m/n×100% shingling mode if m=n−r+1;

(e) rotating the line feeding motor by the single step to increase the parameter m by 1 and perform printing on the $m^{th}$ through $n^{th}$ back edge regions of the printing paper in the 1/n×100% shingling mode;

(f) rotating the line feeding motor such that the second through $m^{th}$ back edge regions of the printing paper is drawn out from the ink head, to perform printing on the $m^{th}$ through $n^{th}$ back edge regions in the 1/n×100% shingling mode; and (g) rotating the line feeding motor by the single step to increase the parameter m by 1 and perform printing on the $m^{th}$ through nback edge regions in the 1/n ×100% shingling mode until m=n.

21. The shingling method of claim 20, wherein the printing paper has one of different sizes.

22. The shingling method of claim 20, wherein the printing apparatus comprises paper feed and paper exit rollers disposed in the paper advance direction and a plurality of ribs disposed at intervals between the paper feed roller and the paper exit roller in a direction perpendicular to the paper advance direction.

23. The shingling method of claim 20, wherein, in the operation (b), ink is discharged from the nozzle sections of the ink head excluding a nozzle section r.

24. The shingling method of claim 20, wherein, in the operation (c), ink is discharged from nozzle sections (r+m−1) through r positioned above the first through $m^{th}$ back edge regions of the printing paper.

25. The shingling method of claim 20, wherein, in the operation (a), ink is discharged from nozzle sections r through 2 of the ink head positioned above the $m^{th}$ and $n^{th}$ back edge regions of the printing paper.

26. The shingling method of claim 20, wherein, in the operation (f), the line feeding motor is rotated by n−r+1 steps, and ink is discharged from nozzle sections n through m of the ink head positioned above the $m^{th}$ through $n^{th}$ back edge regions of the printing paper.

27. The shingling method of claim 26, wherein n is an integer greater than 3.

28. The shingling method of claim 20, wherein n is an integer greater than 3.

29. A shingling method for back edge printing in a printing apparatus having an ink head and a line feeding motor feeding a sheet of printing paper in a paper advance direction, the method comprising:

(a) setting a 1/n×100% shingling mode as a default of the printing apparatus to divide a nozzle portion of the ink head into nozzle sections 1 through n in the paper advance direction and a back edge region of the printing paper into first through $n^{th}$ back edge regions having the same width as each nozzle section of the ink head in the paper advance direction;

(b) rotating the line feeding motor so that the first back edge region of the printing paper lines up beneath nozzle section r, where 1<r<n, of the ink head, to set a parameter m, which is an integer indicating the number of printing operations, to 1, and to perform printing on regions of the printing paper excluding the first back edge region in the 1/n×100% shingling mode;

(c) rotating the line feeding motor by a single step corresponding to the width to increase the parameter m by 1 and perform printing on regions of the printing paper excluding the first through $m^{th}$ back edge regions in the 1/n×100% shingling mode;

(d) repeating operation (c) until m=n−r, to perform printing on the first through nth back edge regions in a m/n×100% shingling mode if m=n−r+1;

(e) rotating the line feeding motor by (n−r+1) steps to increase the parameter m by 1 and perform printing on the $m^{th}$ through $n^{th}$ back edge regions of the printing paper in the 1/n×100% shingling mode; and (f) rotating the line feeding motor by the single step to increase the parameter m by 1 and perform printing on the $m^{th}$ through $n^{th}$ back edge regions of the printing paper in the 1/n×100% shingling mode until m=n.

30. The shingling method of claim 29, wherein the printing paper has one of different sizes.

31. The shingling method of claim 29, wherein the printing apparatus comprises paper feed and paper exit rollers disposed in the paper advance direction and a plurality of ribs disposed at intervals between the paper feed roller and the paper exit roller in a direction perpendicular to the paper advance direction.

32. The shingling method of claim 29, wherein, in the operation (b), ink is discharged from the nozzle sections of the ink head excluding a nozzle section r.

33. The shingling method of claim 29, wherein, in the operation (c), ink is discharged from the nozzle sections of the ink head excluding nozzle sections (r+m−1) through r positioned above the first through $m^{th}$ back edge regions of the printing paper.

34. The shingling method of claim 29, wherein n is an integer greater than 3.

35. The shingling method of claim 29, wherein, in the operation (d), ink is discharged from nozzle sections n through 1 of the ink head positioned above the first through $n^{th}$ back edge regions of the printing paper.

36. The shingling method of claim 35, wherein n is an integer greater than 3.

37. The shingling method of claim 29, wherein, in the operation (e), ink is discharged from nozzle sections n through m of the ink head positioned above the $m^{th}$ through $n^{th}$ back edge regions of the printing paper.

38. The shingling method of claim 37, wherein n is an integer greater than 3.

39. The shingling method of claim 29, wherein, in the operation (f), ink is discharged from nozzle sections n through m of the ink head positioned above the $m^{th}$ through $n^{th}$ back edge regions of the printing paper.

40. The shingling method of claim 39, wherein n is an integer greater than 3.

41. A shingling method for back edge printing in a printing apparatus having an ink head and a line feeding motor feeding a sheet of printing paper in a paper advance direction, the method comprising:

(a) setting a 1/n×100% shingling mode as a default of the printing apparatus to divide a nozzle portion of the ink head into nozzle sections 1 through n in the paper advance direction and a back edge region of the printing paper into first through $n^{th}$ back edge regions having the same width as each nozzle section of the ink head in the paper advance direction;

(b) rotating the line feeding motor so that the first back edge region of the printing paper lines up beneath the nozzle section 2 of the ink head, to set a parameter m, which is an integer indicating the number of printing operations, to 1, and to perform printing on regions of the printing paper excluding the first back edge region in the 1/n×100% shingling mode;

(c) rotating the line feeding motor by a single step corresponding to the width to increase the parameter m by 1 and perform printing on regions of the printing paper excluding the first through $m^{th}$ back edge regions in the 1/n×100% shingling mode;

(d) repeating operation (c) until m=n−2, to perform printing on the first through $n^{th}$ back edge regions of the printing paper in a m/n×100% shingling mode if m=n−1; and (e) rotating the line feeding motor by (n−1) steps to increase the parameter m to n and perform printing on the $n^{th}$ back edge region of the printing paper in the 1/n×100% shingling mode.

42. The shingling method of claim 41, wherein the printing paper has one of different sizes.

43. The shingling method of claim 41, wherein the printing apparatus comprises paper feed roller and paper exit rollers disposed in the paper advance direction and a plurality of ribs disposed at intervals between the paper feed roller and the paper exit roller in a direction perpendicular to the paper advance direction.

44. The shingling method of claim 41, wherein, in the operation (b), ink is discharged from the nozzle sections of the ink head excluding nozzle section 2.

45. The shingling method of claim 41, wherein, in the operation (c), ink is discharged from the nozzle sections of the ink head excluding nozzle sections nozzle sections (m+1) through 2 positioned above the first through $m^{th}$ back edge regions of the printing paper.

46. The shingling method of claim 41, wherein, in the operation (d), ink is discharged from nozzle sections n through 1 positioned above the first through $n^{th}$ back edge regions of the printing paper.

47. The shingling method of claim 46, wherein n is an integer greater than 3.

48. The shingling method of claim 41, wherein n is an integer greater than 3.

49. A shingling method for front edge printing in a printing apparatus having an ink head and a line feeding motor feeding a sheet of printing paper in a paper advance direction, the method comprising:

setting one of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes;

rotating the line feeding motor by a step corresponding to the width, so that a first number of the edge regions of the printing paper are overlapped with the first number of the nozzle sections of the ink head to be printed by the overlapped first number of the nozzle sections of the ink head; and rotating the line feeding motor by a plurality of steps without printing, so that a second number of the edge regions of the printing paper are overlapped with the second number of the nozzle sections of the ink head to be printed by the overlapped second number of the nozzle sections of the ink head.

50. A shingling method for front edge printing in a printing apparatus having an ink head and a line feeding motor feeding a sheet of printing paper in a paper advance direction, the method comprising:

setting one of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes;

rotating the line feeding motor by a step corresponding to the width, so that a first number of the edge regions of the printing paper are overlapped with the first number of the nozzle sections of the ink head to be printed by the overlapped first number of the nozzle sections of the ink head; and rotating the line feeding motor by a plurality of steps without printing, so that a second number of the edge regions of the printing paper are overlapped with the second number of the nozzle sections of the ink head to be printed by a third number of the nozzle sections less then the overlapped second number of the nozzle sections of the ink head.

51. A shingling method for front edge printing in a printing apparatus having an ink head and a line feeding motor feeding a sheet of printing paper in a paper advance direction, the method comprising:

setting one of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes; and controlling the line feeding motor to rotate by a step or a plurality of steps each corresponding to the width, so that a first number of the edge regions of the printing paper are overlapped with the first number of the nozzle sections of the ink head to be printed by a second number of the nozzle sections less than the first number of the nozzle sections of the ink head, wherein the edge printing regions are completely printable without a nonprintable border area.

52. A shingling method for front edge printing in a printing apparatus having an ink head and a line feeding motor feeding a sheet of printing paper in a paper advance direction, the method comprising:

setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes; and controlling the line feeding motor to rotate by a step or a plurality of steps each corresponding to the width to print a first number of the edge regions of the printing paper according to the one of the shingling modes and a second number of the edge regions of the printing paper according to another one of the shingling modes, wherein the first number of the edge regions and the second number of the edge regions correspond to an edge region that is completely printable without a nonprintable border area.

53. A shingling method for front edge printing in a printing apparatus having an ink head and a line feeding motor feeding a sheet of printing paper in a paper advance direction, the method comprising:

setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes such that the entire edge portion of the printing paper is printable;

controlling the line feeding motor to rotate by a step or a plurality of steps each corresponding to the width; and controlling a first number of the nozzle sections to discharge ink toward corresponding ones of the edge regions and a second number of nozzle sections not to discharge the ink toward corresponding ones of the edge regions according to a rotation of the line feeding motor by one of the step and the plurality of steps.

54. A shingling apparatus for edge printing in a printing apparatus having an ink head and a line feeding motor feeding a sheet of printing paper in a paper advance direction, the shingling apparatus comprising:

a print setting unit setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes; and a controller controlling the line feeding motor to rotate by a step or a plurality of steps each corresponding to the width to print a first number of the edge regions of the printing paper using the nozzle sections according to the one of the shingling modes, and to print a second number of the edge regions of the printing paper using the nozzle sections according to another one of the shingling modes, wherein the edge printing regions are completely printable without a nonprintable border area.

55. A shingling apparatus for edge printing in a printing apparatus having an ink head and a line feeding motor feeding a sheet of printing paper in a paper advance direction, the shingling apparatus comprising:

a print setting unit setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes; and a controller controlling the line feeding motor to rotate by a step or a plurality of steps each corresponding to the width to print a first number of the edge regions of the printing paper according to the one of the shingling modes and a second number of the edge regions of the printing paper according to another one of the shingling modes, wherein the first number of the edge regions and the second number of the edge regions correspond to an edge region that is completely printable without a nonprintable border area.

56. A shingling apparatus for front edge printing in a printing apparatus having an ink head and a line feeding motor feeding a sheet of printing paper in a paper advance direction, the shingling apparatus comprising:

a print setting unit setting one of a plurality of shingling modes as a shingling printing mode of the printing apparatus to print an edge portion of the printing paper to divide a nozzle portion of the ink head into a plurality of nozzle sections in the paper advance direction and the edge portion of the printing paper into a plurality of edge regions each having the same width as each nozzle section of the ink head in the paper advance direction according to the one of the shingling modes such that the entire edge portion of the printing paper is printable; and a controller controlling the line feeding motor to rotate by a step or a plurality of steps each corresponding to the width, and controlling a first number of the nozzle sections to discharge ink toward corresponding ones of the edge regions and a second number of nozzle sections not to discharge the ink toward corresponding ones of the edge regions according to a rotation of the line feeding motor by one of the step and the plurality of steps.

* * * * *

UNITED STATES PATENT AND TRADEMARK OFFICE

CERTIFICATE OF CORRECTION

PATENT NO. : 6,837,569 B2
DATED : January 4, 2005
INVENTOR(S) : Hyun Kim

It is certified that error appears in the above-identified patent and that said Letters Patent is hereby corrected as shown below:

Column 29,
Line 57, change "prining" to -- printing --

Column 30,
Line 52, "after comprises:" enter paragraph return

Column 31,
Line 20, change "trough" to -- through --

Column 32,
Line 37, change "nback" to -- nth back --
Line 55, change "(a)" to -- (e) --

Column 34,
Line 49, remove second "nozzle sections" (repeated twice)

Column 35,
Line 43, change "then" to -- than --

Signed and Sealed this

Fifth Day of July, 2005

JON W. DUDAS
*Director of the United States Patent and Trademark Office*